US012060879B2

(12) United States Patent
Giampuzzi et al.

(10) Patent No.: US 12,060,879 B2
(45) Date of Patent: Aug. 13, 2024

(54) SYSTEM AND METHOD FOR DISPENSING LIQUIDS

(71) Applicant: Voyager Products Inc., Toronto (CA)

(72) Inventors: Paolo Anton Giampuzzi, Mississauga (CA); Elad Barak, Toronto (CA); Art de Guzman, Toronto (CA); Andres Choy Buentello, North York (CA)

(73) Assignee: Voyager Products Inc., Toronto (CA)

( * ) Notice: Subject to any disclaimer, the term of this patent is extended or adjusted under 35 U.S.C. 154(b) by 0 days.

(21) Appl. No.: 17/845,179

(22) Filed: Jun. 21, 2022

(65) Prior Publication Data

US 2022/0316469 A1 Oct. 6, 2022

Related U.S. Application Data

(63) Continuation-in-part of application No. 16/943,045, filed on Jul. 30, 2020, now Pat. No. 11,396,417.

(60) Provisional application No. 63/035,539, filed on Jun. 5, 2020, provisional application No. 62/880,230, filed on Jul. 30, 2019.

(51) Int. Cl.

| | |
|---|---|
| ***F04B 53/06*** | (2006.01) |
| ***A24F 40/485*** | (2020.01) |
| ***F04B 23/02*** | (2006.01) |
| ***F04B 45/04*** | (2006.01) |
| ***F04B 53/16*** | (2006.01) |

(52) U.S. Cl.

CPC ..... *F04B 53/06* (2013.01); *F04B 23/02* (2013.01); *F04B 45/04* (2013.01); *F04B 53/16* (2013.01); *A24F 40/485* (2020.01)

(58) Field of Classification Search

CPC .... A61J 2200/70; A61J 7/0053; A61J 7/0418; A61J 7/0445; A61J 7/0084; B65D 83/0094

USPC ..... 222/422, 206; 422/502

See application file for complete search history.

(56) References Cited

U.S. PATENT DOCUMENTS

| | | | |
|---|---|---|---|
| 5,653,227 | A | 8/1997 | Barnes et al. |
| 7,677,412 | B2 | 3/2010 | Litterst et al. |

(Continued)

FOREIGN PATENT DOCUMENTS

| | | | | |
|---|---|---|---|---|
| CA | 3059311 | A1 | 7/2009 | |
| DE | 102006043637 | A1 * | 11/2007 | ..... A61M 11/006 |

(Continued)

OTHER PUBLICATIONS

International Search Report dated Jan. 6, 2021 issued in PCT/IB2020/000650.

(Continued)

*Primary Examiner* — Bob Zadeh
*Assistant Examiner* — Michael J. Melaragno
(74) *Attorney, Agent, or Firm* — Kubota & Basol LLP

(57) ABSTRACT

The present invention is directed to a dispensing system, device, and method for the dispensing of a fluid supplement such as in the form of a concentrated fluid containing flavoring, nutrients, medication, and/or other supplements. Certain embodiments of the invention as disclosed herein comprise a handheld apparatus which allows the dispensing of predetermined amount of a fluid with single-handed use. Certain embodiments include self-contained pods which is controlled by a removable dispenser to allow for multiple types of fluids, and preventing cross-contamination within the dispenser.

19 Claims, 20 Drawing Sheets

(56) References Cited

U.S. PATENT DOCUMENTS 8,240,304 B2 * 8/2012 Thoemmes ..... A61M 15/0075 239/338
8,414,563 B2 4/2013 Kamen et al.
8,584,673 B2 11/2013 Thoemmes et al.
8,893,927 B2 * 11/2014 Olson ..... C02F 1/003 222/162
8,905,964 B2 * 12/2014 Poutiatine ..... G16H 20/13 604/59
9,247,773 B2 * 2/2016 Memari ..... A24F 40/60
9,320,301 B2 * 4/2016 Memari ..... A24F 40/90
9,542,826 B2 * 1/2017 Edwards ..... G09B 9/00
9,668,522 B2 * 6/2017 Memari ..... H02J 7/00
9,836,948 B2 * 12/2017 Edwards ..... A61M 5/31
9,848,647 B2 * 12/2017 Memari ..... A24F 40/60
9,848,648 B2 * 12/2017 Memari ..... B65D 25/005
9,883,697 B2 * 2/2018 Memari ..... B65D 25/005
9,937,303 B1 4/2018 Yeates et al.
9,955,736 B2 * 5/2018 Memari ..... B65B 3/04
9,986,770 B2 * 6/2018 Memari ..... A24F 40/60
9,993,029 B2 * 6/2018 Memari ..... H02J 50/10
9,993,030 B2 * 6/2018 Memari ..... H05K 999/99
9,993,031 B2 * 6/2018 Memari ..... H02J 7/0044
9,993,032 B2 * 6/2018 Memari ..... A24F 40/60
9,993,033 B2 * 6/2018 Memari ..... H02J 7/00
9,999,259 B2 * 6/2018 Memari ..... B65D 25/005
9,999,260 B2 * 6/2018 Memari ..... A24F 40/90
10,015,995 B2 * 7/2018 Memari ..... B65B 37/06
10,015,996 B2 * 7/2018 Memari ..... H05K 999/99
10,021,916 B2 * 7/2018 Memari ..... B65D 25/005
10,229,578 B2 * 3/2019 Edwards ..... A61M 15/08
10,632,432 B2 * 4/2020 Wilson ..... B01F 33/8442
10,674,857 B2 * 6/2020 Lyons ..... A47J 31/005
10,726,701 B2 * 7/2020 Edwards ..... H04B 1/3827
10,940,290 B2 * 3/2021 Singh ..... A61M 25/007
11,071,831 B2 * 7/2021 Bauer ..... A61M 5/31551
11,109,800 B2 * 9/2021 Hooven ..... A61B 5/01
11,396,417 B2 * 7/2022 Giampuzzi ..... A61J 7/0084
2003/0178024 A1 9/2003 Allan et al.
2005/0087555 A1 * 4/2005 Hatton ..... A47K 5/1208 222/494
2006/0049208 A1 * 3/2006 Daansen ..... B65D 47/2031 222/212
2007/0000337 A1 1/2007 Gross
2007/0181611 A1 * 8/2007 Julian Pidevall ... B05B 11/1032 222/409
2007/0186923 A1 8/2007 Poutiatine et al.
2007/0267015 A1 * 11/2007 Thoemmes ..... A61M 15/0048 128/200.24
2008/0001008 A1 * 1/2008 Thoemmes ..... A61M 15/005 239/338
2008/0163695 A1 7/2008 Ichikawa
2009/0194562 A1 8/2009 Kessler et al.
2010/0132748 A1 6/2010 Kessler et al.
2012/0085344 A1 4/2012 Luber et al.
2012/0218333 A1 8/2012 Nishikawa
2013/0085460 A1 4/2013 Voss et al.
2013/0172831 A1 7/2013 Voss et al.
2013/0255404 A1 10/2013 Mohr et al.
2014/0366871 A1 * 12/2014 Thoemmes ..... A61M 15/00 128/200.14
2015/0136158 A1 5/2015 Stevens et al.
2015/0150803 A1 6/2015 Boucher et al.
2015/0151857 A1 6/2015 Lanigan et al.
2015/0157053 A1 6/2015 Mayor
2015/0245654 A1 9/2015 Memari et al.
2015/0247786 A1 9/2015 Parker et al.
2015/0260179 A1 * 9/2015 Hatton ..... B05B 11/007 417/395
2015/0294551 A1 10/2015 Edwards et al.
2015/0305974 A1 10/2015 Ehrenreich et al.
2016/0213065 A1 7/2016 Wensley et al.
2017/0092101 A1 * 3/2017 Edwards ..... A61M 5/20
2017/0233114 A1 8/2017 Christensen et al.
2017/0245552 A1 8/2017 Reevell
2018/0033286 A1 * 2/2018 Edwards ..... G08B 21/185
2018/0038357 A1 2/2018 Demers et al.
2018/0177325 A1 6/2018 Lyons et al.
2019/0105619 A1 4/2019 Wilson et al.
2019/0206220 A1 * 7/2019 Edwards ..... A61M 15/0001
2019/0307170 A1 10/2019 Zarifian et al.
2020/0022416 A1 1/2020 Alarcon
2020/0061337 A1 2/2020 Singh et al.
2020/0061362 A1 2/2020 Singh et al.
2020/0113787 A1 4/2020 Sirdeshmukh et al.
2020/0114087 A1 4/2020 Bauer et al.
2020/0163389 A1 5/2020 Sur
2020/0214625 A1 7/2020 Hooven et al.
2020/0367553 A1 11/2020 Hejazi
2020/0406205 A1 * 12/2020 Wilson ..... B01F 33/8442
2021/0023315 A1 1/2021 Goldenberg et al.
2021/0023585 A1 1/2021 Fliess et al.
2021/0052007 A1 2/2021 Mabee et al.
2021/0052013 A1 2/2021 Mabee et al.
2021/0170095 A1 6/2021 DiPerna et al.
2021/0354168 A1 11/2021 Fliess
2022/0316469 A1 * 10/2022 Giampuzzi ..... F04B 53/16

FOREIGN PATENT DOCUMENTS

DE 102006043637 A1 11/2007
WO WO-2007134793 A1 * 11/2007 ..... A61M 11/006
WO WO-2007134794 A1 * 11/2007 ..... A61M 11/006
WO 2007092618 A3 12/2007
WO 2015112750 A1 7/2015

OTHER PUBLICATIONS

Notice of Allowance issued Apr. 1, 2022 in U.S. Appl. No. 16/943,045.
Written Opinion dated Jan. 6, 2020 issued in PCT/IB2020/000650.

* cited by examiner

SECTION
H-H

SECTION
J-J

DETAIL H

DETAIL J

SYSTEM AND METHOD FOR DISPENSING LIQUIDS

CROSS REFERENCE TO RELATED APPLICATIONS

This application is a Continuation in Part of U.S. patent application Ser. No. 16/943,045 entitled "SYSTEM AND METHOD FOR DISPENSING LIQUIDS", filed Jul. 30, 2020 which claims benefit to U.S. Provisional Patent Application No. 62/880,230, entitled "SYSTEM AND METHOD FOR DISPENSING LIQUIDS", filed Jul. 30, 2019; and U.S. Provisional Patent Application No. 63/035,539 entitled "SYSTEM AND METHOD FOR DISPENSING LIQUIDS", filed on Jun. 5, 2020, which are incorporated by reference in their entireties for all purposes.

FIELD OF THE INVENTION

The present invention is directed to a dispensing device, system, and method for the dispensing of a fluid supplement. The dispensing of fluids, such as in the form of a concentrated fluid containing flavoring, nutrients, medication, and/or other supplements. The system as provided in certain embodiments, comprises a handheld apparatus which allows the dispensing of predetermined amount of a fluid with single-handed use.

BACKGROUND OF THE INVENTION

The use of concentrates for the addition of a supplement is a common method of administering supplements—such as vitamins, medication, and electrolytes. Particularly in the field of administering medication, the practice of using fluids has been adopted for ease of use, for those that have difficulty swallowing, as well as those that simply prefer to administer their supplements in fluid form to imbibe with a beverage. Recently the use of cannabis-based medications and treatments have increased in use, however the traditional means of ingesting cannabis-based medications including compounds such as tetrahydrocannabinol (THC) or cannabidiol (CBD) may be impractical, socially unacceptable, inappropriate, or undesirable.

A traditional means of ingesting or administering cannabis-based medications is the inhalation of smoke generated through the burning of portions of the cannabis plant. This method is imprecise with regard to the dosage to an individual and is increasingly discouraged in public settings. Furthermore, the inhalation of smoke are not recommended for certain users—such as children, the elderly, and those who are in a state of respiratory compromise—who may benefit from the use of cannabis derived compounds. For instance, cannabis derived compounds are used frequently for patients undergoing chemotherapy in efforts to stimulate hunger. Furthermore, in the medical community, there have been clinical findings which indicate that the use of CBD assists in the treatment and reduction of seizures in children suffering from severe forms of epilepsy such as Lennox-Gastaut syndrome and Dravet Syndrome.

Another popular means for the ingesting of cannabis-based compound surrounds the act of "vaping," which operate on a similar basis as electronic cigarettes. Vaping surrounds the vaporization of a fluid within which the cannabis compound is contained. Pulmonary health concerns exist surrounding the act of vaping as vaping has shown in some clinical trials to result in inflammation of the lungs and lung damage. In some cases, vaping has been attributed as a cause of death in some individuals. A further risk associated with vaping surrounds the dosage. The dose amount when vaping is heavily dependent upon a user and the amount they inhale.

A more recent means of ingesting or administering cannabis-based medications is the oral ingestion of prepared edible portions which are prepared in a form such as cookies, gummy candies, or other edible forms. This method, although more precise and less likely to create corresponding health-risks, is still imprecise and is unable to be personalized for a specific user to provide appropriate dosage, track dosage, and to prevent over-dosage. Furthermore, mistakenly ingesting such edibles may create unsafe situation such as overdosing which results in an undesirable psychological state, particularly with children.

For reasons such as those discussed above, there is a need for an apparatus and method for the administration of cannabis-based supplements in a precise, safe, and discrete manner.

SUMMARY OF THE INVENTION

It is an aspect of the present invention to provide a device and method for the accurate and precise dispensing of a fluid. The present invention surrounds the use of a dispenser unit which interconnects with interchangeable pods for the purposes of dispensing different fluids. The dispenser unit reads and records unique identifying information from the pod by reading a unique identifier or using a digital key to gain access to the dispenser function. The identifying information includes, but is not limited to minimum dosage, maximum dosage, potency, viscosity, electric requirements for pod operation, remaining fluid in the pod, recommended intervals for dosing, and predefined dose.

The interchangeability of pods with the dispenser allows a user to easily change the fluid, which is dispensed by the device, thereby negating the need to completely exhaust a first pod prior to using a second pod, and allowing a user to dispense different fluids without the need to carry multiple devices. Rather a user may carry a single dispenser and a plurality of pods which are configured to interconnect with the dispenser.

It is an aspect of the present invention to prevent accidental or unauthorized dispensing of fluid from a pod of certain embodiments. A combination of one-way valves, and anti-suction elements prevent the leakage of fluid from a pod. A one-way valve intended for filling the pod for instance, allows the filling of a reservoir from an external aspect of the pod, but does not allow flow of the liquid in the opposite direction. The "external aspect" as used herein is defined to include the common and ordinary meaning of the term, and the ambient environment surrounding the pod and device.

In certain embodiments a dispensing nozzle is configured to be large enough to allow the fluid to dispense under pressure, however the nozzle is small enough wherein the cohesive forces within the fluid prevent the fluid from leaking out of the nozzle. Embodiments wherein the dispensing nozzle is used in independently or in conjunction with a one-way valve are within the spirit and scope of the present invention. Furthermore, embodiments wherein a first one-way valve and a second one-way valve are used in series for the dispensing of a fluid are within the spirit and scope of the present invention. In certain embodiments the nozzle or second one-way valve used in conjunction with a first one-way valve serves to maintain backpressure on first one-way valve wherein the backpressure on the first one-way valve in order to maintain the first one-way valve sealed and thereby prevent leakage therethrough.

Furthermore, a one-way valve intended for dispensing a fluid in certain embodiments for instance, allows flow of fluid from the pod to an external aspect of the pod further. The one-way valve further comprises an anti-suction feature. For instance, certain embodiments comprise an anti-suction channel connecting the external aspect of the one-way valve to an aspect of the pod wherein a user is unable to place their mouth over the one-way valve to suck the fluid from the pod. Sucking on the dispensing region of a pod would only result in drawing air from an external aspect of the pod located away from the one-way valve.

Many portable devices for the ingesting of a fluid, such as vape pens and electronic cigarettes, rely on the user to draw in the fluid with their breath. This mode of delivery is imprecise and unreliable.

It is an aspect of the present invention to provide a repeatable, reliable, and precise means for dispensing a fluid for ingestion. A dispenser and pod of certain embodiments allows the repeatable delivery of a predetermined amount. Furthermore, the dispenser tracks the amount dispensed, time of dispensing, and type of fluid dispensed.

It is a further aspect of the present invention that a dispenser interconnects with disposable or reusable pods wherein the fluid is contained. The pods have a self-contained dispensing mechanism actuated by the dispenser. Thus, the dispenser does not have direct contact with fluid and does not require cleaning. Furthermore, the lack of direct contact of fluid with the dispenser prevents cross-contamination of fluids when changing pods.

It is an aspect of the present invention to mitigate air bubbles within a fluid dispensing device. Air bubbles entrained in a fluid dispensing device can negatively affect the use of a fluid dispensing device wherein the air bubbles prevent the dispensing of a fluid or result in inaccurate amounts of fluid being dispensed. In certain embodiments an inlet port wherethrough liquid is drawn into the diaphragm pump, is located above the outlet port when the pod is in an upright configuration. The location of the inlet port above the outlet port prevents entrained air-bubbles from being forced through the outlet port during an ejection stroke of the diaphragm pump. Thus, any air bubbles that enter the diaphragm pump have a tendency to rise upward and away from the outlet port of the diaphragm pump.

In certain embodiments, a siphon tube—which transmits fluid from a reservoir to the inlet port of the diaphragm pump—further comprises an air chamber configured to trap air bubbles and prevent their entrance into the diaphragm pump through the inlet port. The air chamber comprises a volume located above the inlet port wherein air bubbles which travel up the siphon tube are captured in the air chamber. In certain embodiments a semi-permeable membrane is interconnected with the air chamber and is configured to be permeable to air but not to a liquid. The semi-permeable allows air which is captured in the air chamber to permeate therethrough to prevent a build-up of air in the air chamber. In certain embodiments the semi-permeable membrane allows air to pass from the air chamber to the ambient air, while alternate embodiments of the semi-permeable membrane to pass from the air chamber to the reservoir.

In certain embodiments, a siphon tube comprises a mechanism for preventing the entry or entrainment of air bubbles within the fluid or siphon tube to prevent the delivery of air bubbles into the diaphragm pump. The mechanism, such as a float vent valve, comprises a float configured to be buoyant in the fluid held within the pod wherein when the pod is in an inverted configuration, the float traverses toward the inlet apertures of the siphon tube. The inlet end of the siphon tube constricts inward wherein the float impedes the flow of fluid or air and prevents the entry of air into the siphon tube. In a medial portion of the siphon tube located between the inlet end of the siphon tube and the outlet end of the siphon tube, a fluid bypass allows fluid to pass around the float and drawn through the siphon tube toward the pump inlet during an intake stroke.

It is a known challenge as related to cannabis related products wherein hydrophobic materials or hydrophobic coatings can attract cannabinoid compounds and therefore lowers the cannabinoid content of an infused liquid. This reduces the intended potency or concentration of a given fluid and can result in inconsistent dosing. It is an aspect of certain embodiments of the present invention to apply a hydrophilic coating within the reservoir to prevent the attraction of cannabinoids of a fluid to the inner surfaces of the reservoir.

These and other advantages will be apparent from the disclosure of the inventions contained herein. The above-described embodiments, objectives, and configurations are neither complete nor exhaustive. Other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 2B—A perspective exploded view of a device for dispensing fluids comprising a dispenser and a removably interconnected pod.

FIG. 4B—A front cross-sectional view of a device for dispensing fluids comprising a pod.

FIG. 5B—A side cross-sectional view of a device for dispensing fluids comprising a pod.

FIG. 6B—A side cross-sectional view of a device for dispensing fluids comprising a pod in an ejection stroke configuration.

DETAILED DESCRIPTION OF VARIOUS EMBODIMENTS

Figure 1:
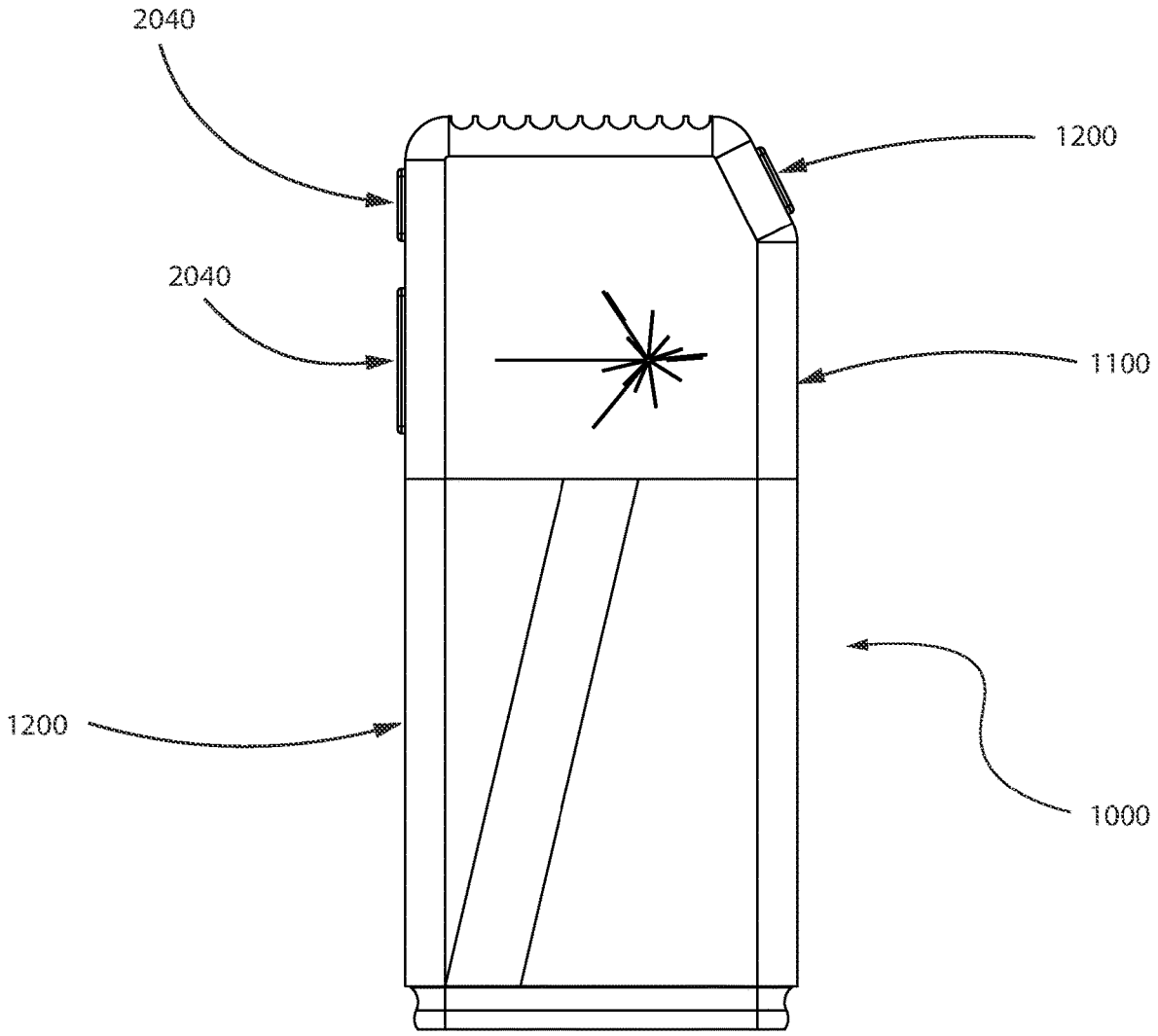
FIG. 1—A front view of certain embodiments of a device for dispensing fluids.
Figure 2A:
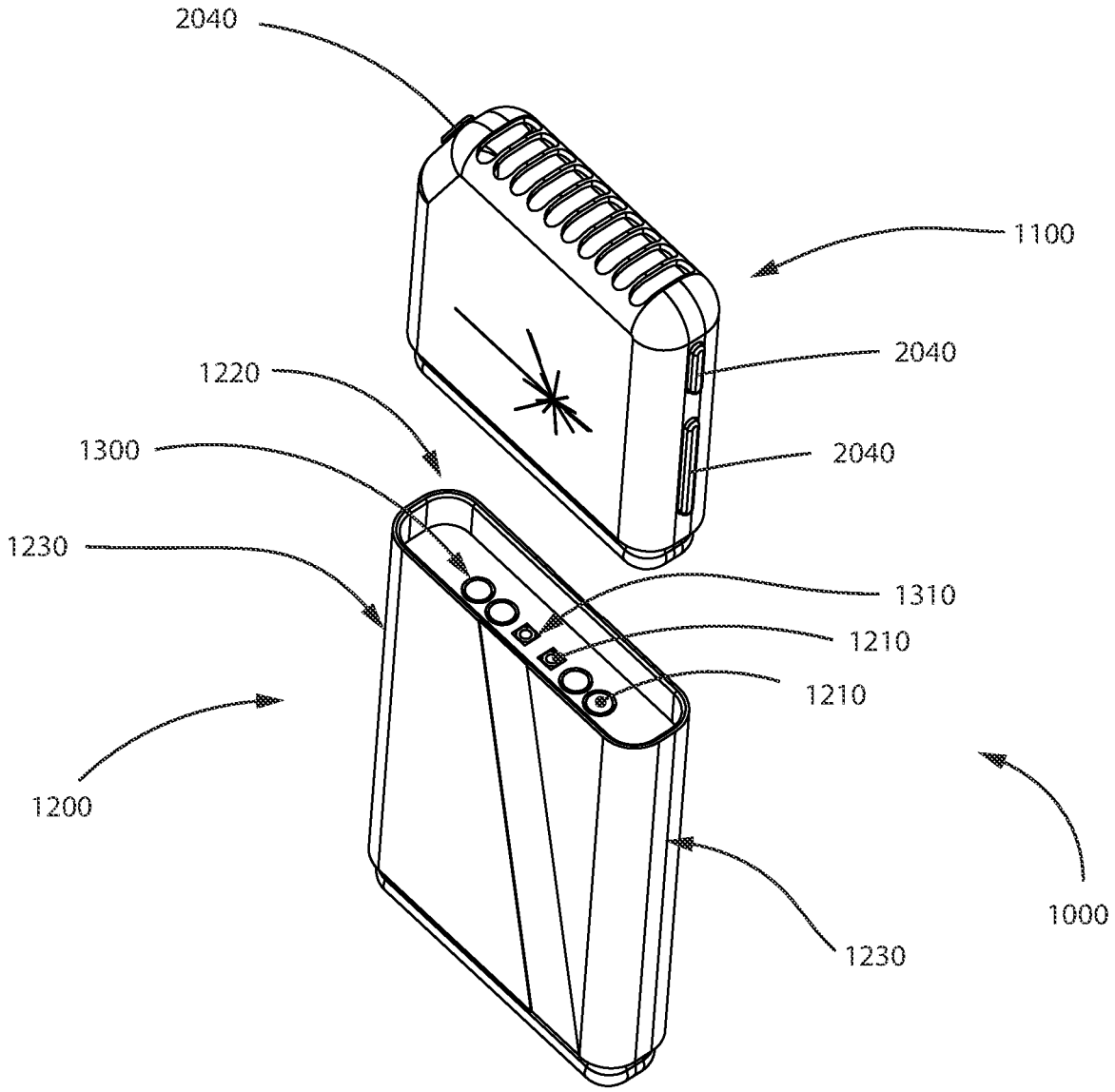
FIG. 2A—A perspective exploded view of a device for dispensing fluids comprising a dispenser and a removably interconnected pod.
Figure 2B:
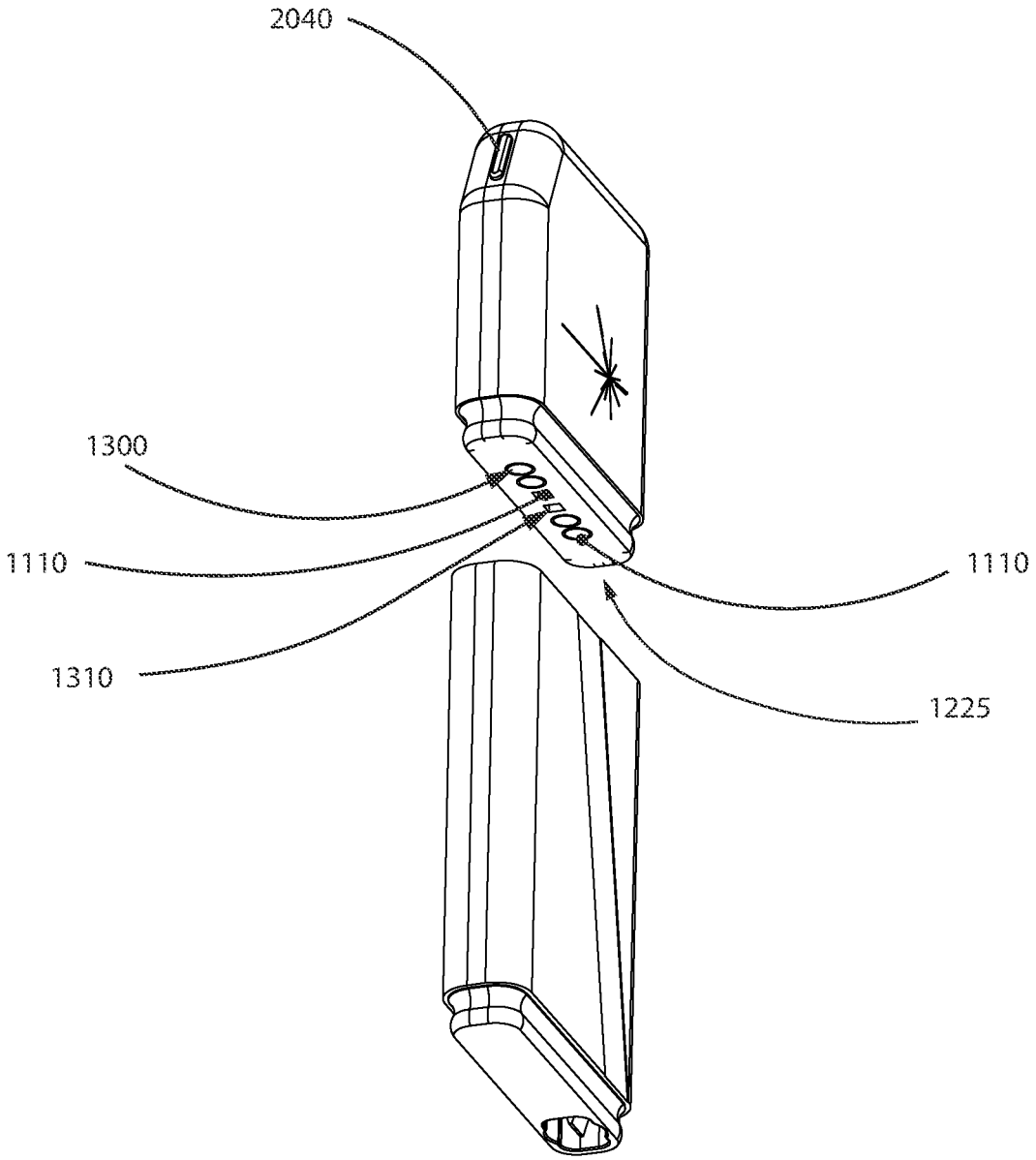
Figure 3:
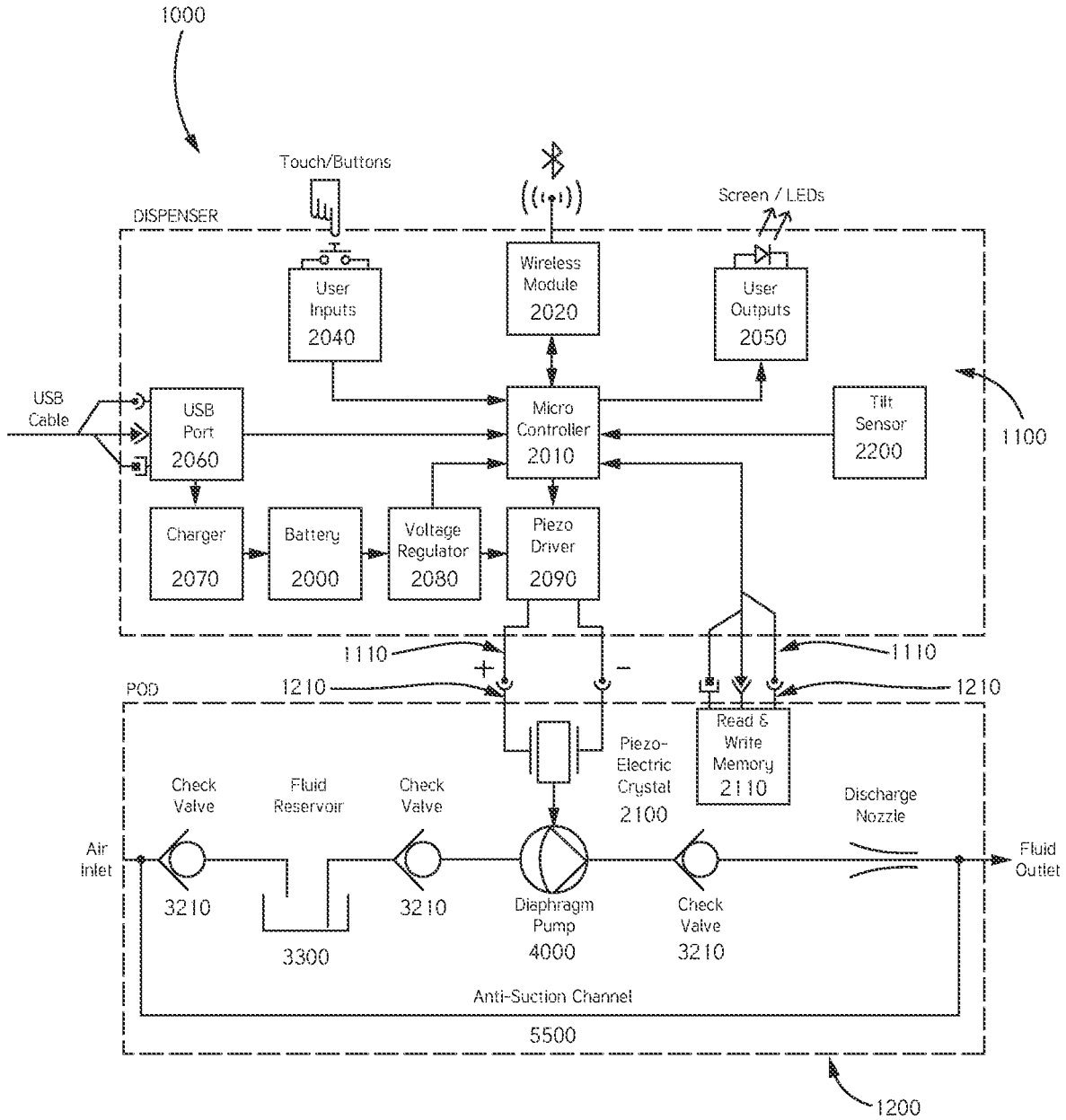
FIG. 3—A diagrammatic system representation of certain embodiments of a device for dispensing a fluid.

Certain embodiments of the present invention, shown in FIG. 1-FIG. 3, comprises a device 1000 for the dispensing of fluids, the device comprises a dispenser 1100 and a pod 1200. The dispenser 1100 comprises a power source 2000, central processing unit or controller (CPU) 2010. As shown, a bottom surface 1105 of the dispenser is configured to interconnect with a top aspect 1220 of the pod. It will be appreciated that the interconnection of the dispenser 1100 with the pod 1200 using alternative sides is within the spirit and scope of the present invention. When the dispenser 1100 is interconnected with the pod 1200, the dispenser 1200 is able to actuate the dispensing of a fluid from the pod 1200 by sending electrical signals from electrical connections 1110 of the dispenser, through electrical connections 1210 of the pod to the pod 1200. It will be appreciated that it is within the spirit and scope of the present invention send electromagnetic signals through electrical connections 1110. The dispenser 1100 of certain embodiments interconnects to the pod through use of electrical connections 1110, such as 1310 which comprise magnets 1300. The magnets 1300 of certain embodiments are located on the pod 1200, alternate embodiments comprise magnets 1300 on the dispenser 1100, and further alternate embodiments comprise magnets 1300 on pod 1200 and dispenser 1100. The magnets 1300 of such embodiments provide a mechanical connection between the pod 1200 and dispenser 1100. It will be appreciated that alternative mechanical connections known to those skilled in the art are within the spirit and scope of the present invention.

In certain embodiments, seen in FIG. 2A-FIG. 3, comprise a pod 1200 having a plurality of magnets 1300 configured to interconnect with a plurality of magnets 1300 of a dispenser. In such certain embodiments, the pod 1200 and the dispenser 1100 are configured to be interconnected with the pod 1200 in a first orientation, or a second orientation wherein the pod 1200 is rotated 180-degrees from the first orientation wherein the magnets 1300 of the dispenser, and the magnets 1300 of the pod are configured to interconnect in either the first orientation or the second orientation.

Certain embodiments, seen in FIG. 2A-FIG. 3, comprise a pod 1200 having a plurality of magnets 1300 configured to interconnect with a plurality of magnets 1300 of a dispenser. It may be desired to prevent the interconnection of a dispenser 1100 in a manner other than intended. Accordingly, the magnets 1300 of certain embodiments are configured in an asymmetric manner to prevent the mating of the dispenser to the pod in a manner other than intended. Further still, certain embodiments comprise a configuration of magnets 1300 on a pod wherein the poles (North and South) of the magnets prevent interconnecting the pod 1200 to the dispenser 1100 incorrectly. For instance, certain embodiments comprise four magnets embedded into a surface of the pod 1200, typically a top aspect 1220, wherein a first pair of magnets 1300 adjacent to a first side 1230 of the pod are directed with a first polarity toward the top aspect 1220, and a second pair of magnets adjacent to a second side 1230 of the pod are directed with a second polarity toward the top aspect 1220. Accordingly, a dispenser 1100 having magnets 1300 configured to interconnect with the magnets 1300 of the pod having opposite polarities, are able to interconnect when the pod 1200 is aligned in the intended orientation. However, if a user attempts to interconnect the pod 1200 with the dispenser 1100 with the pod rotated 180-degrees from the intended orientation for instance, the magnets 1300 of the pod will align with magnets of the dispenser having matching polarities resulting in the dispenser 1100 and pod 1100 repelling each other and preventing the interconnection of the pod 1200 and dispenser 1100.

In certain embodiments, shown in FIG. 2A-FIG. 2B, a top aspect 1220 of a pod comprises a first and second electrical contacts 1210 comprising spring-loaded electrical connectors 1310. The electrical contacts allow the electrical connection between the dispenser 1100 and the pod 1200, and allows the dispenser 1100 to send electrical signals to the pod to dispense an amount of fluid. Certain embodiments comprise spring-loaded electrical connectors 1310 often referred to as "pogo-pins" by those skilled in the art. Certain embodiments comprise the electrical connections 1110 of the dispenser comprising spring-loaded electrical connectors 1310.

Figure 4A:
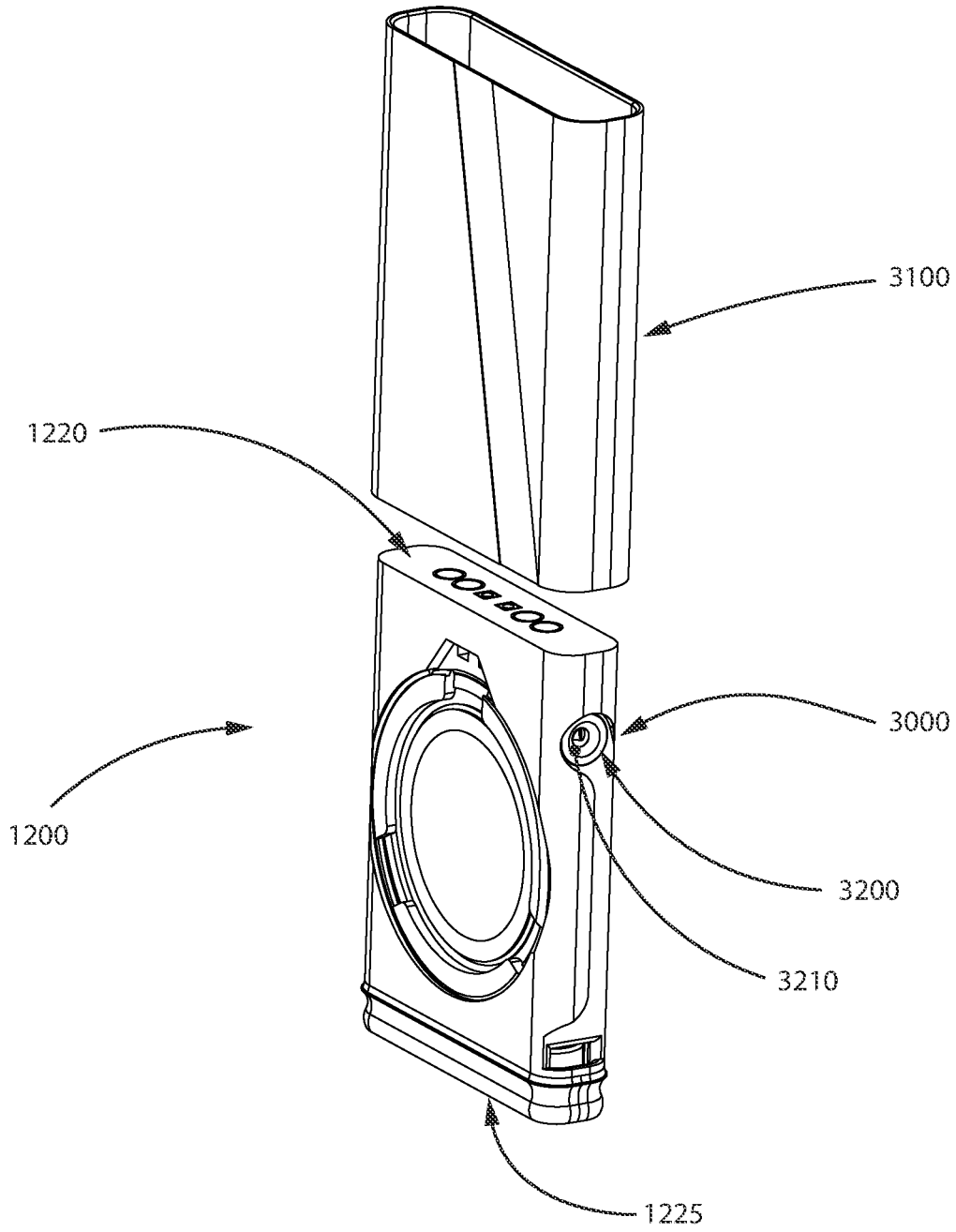
FIG. 4A—A perspective exploded view of a device for dispensing fluids comprising a pod.

Certain embodiments comprising a pod 1200, shown in FIG. 4A comprise a body t surrounded by a sleeve 3100. In certain embodiments the sleeve 3100 is slidably disposed over the body 3000 of the pod. In certain embodiments a sleeve is disposed around the body of the pod, thereby obscuring view and access to portions of the body of the pod except a top aspect 1220 and bottom aspect 1225 of the pod.

Figure 4B:
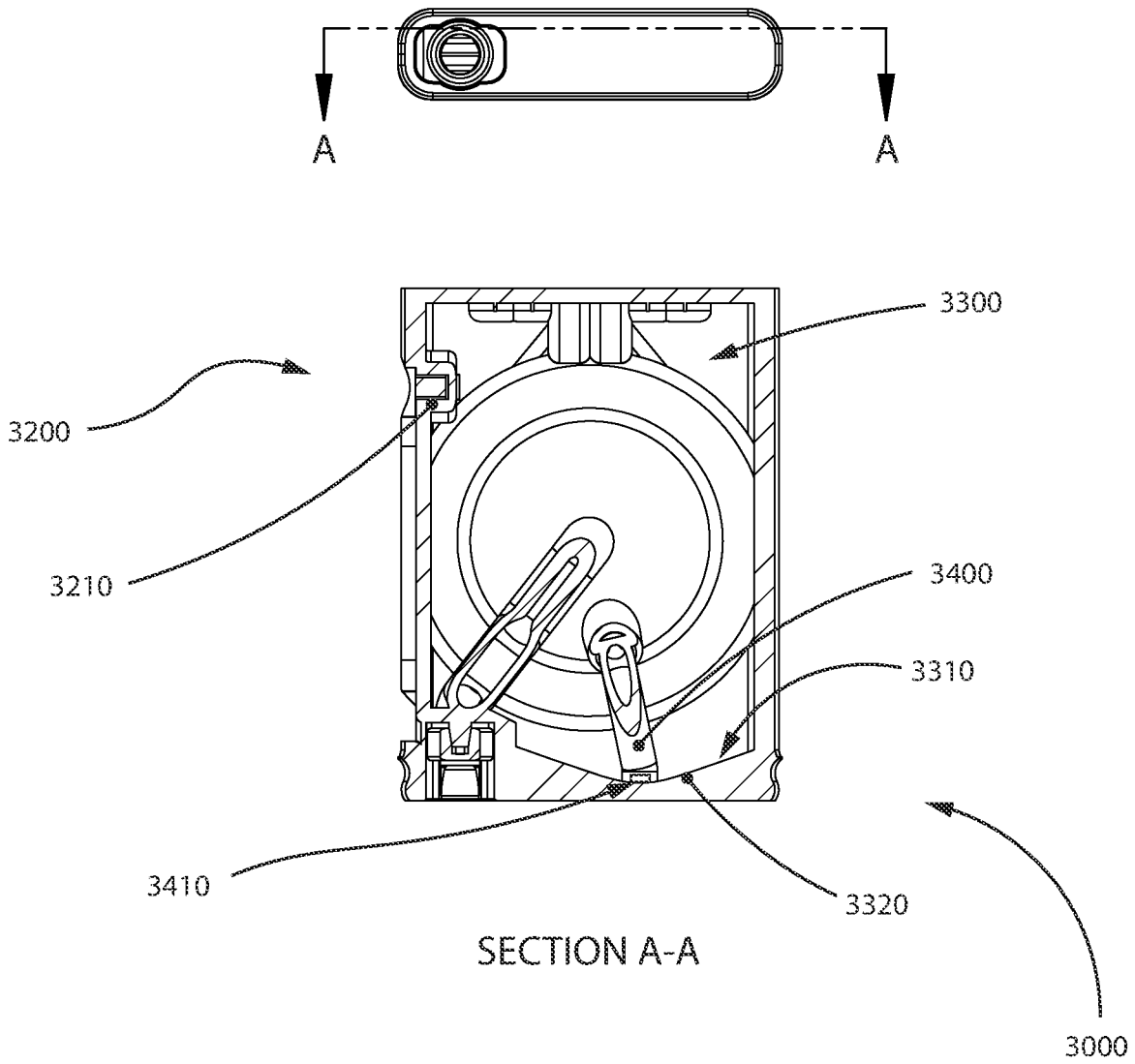

A pod 1200 of certain embodiments, as shown in FIG. 4A-FIG. 4B comprises a body 3000 having a fill-port 3200 comprising a one-way valve 3210 disposed in an external surface of the body 3000. The one-way valve 3210 provides fluid communication between an external aspect of the body and a reservoir 3300 disposed within the body 3000. The fill-port 3200 is typically configured to be adjacent to a top aspect 1220 of the body when the body is held in an orientation for dispensing. However, it will be appreciated that a fill port 3200 can be located adjacent to other aspects of the body 3000—such as a bottom aspect, or side aspect—while in keeping with the spirit and scope of the present invention.

In certain embodiments, shown in FIG. 4B, the reservoir 3300 comprises a cavity within the body 3000 wherein the fluid can be contained and drawn from for the dispensing of the fluid. The reservoir comprises a volume having a bottom aspect 3310 further comprising a sump 3320. It will be appreciated that the term sump refers to a low point, pit, hollow, or concavity configured to accumulate fluid. A sump 3320 is typically disposed at the lowest point of the reservoir 3300 when the body 3000 is held in an orientation for dispensing and thus preventing air from entering into the siphon tube 3400 and into the pump 4000 (FIG. 5A).

In certain embodiments, again referencing FIG. 4B, a siphon tube 3400 is disposed within the sump 3320 of the reservoir to draw fluid from the reservoir 3300 when fluid is dispensed. While embodiments illustrated herein show a siphon tube 3400 which is configured to draw fluid upward from the sump 3320 of the reservoir, it will be appreciated that alternate embodiments comprising a siphon tube 3400 configured to draw fluid downward or laterally from the reservoir 3300 is within the spirit and scope of the present invention. In certain embodiments, the siphon tube 3400 is configured to draw fluid upward from the sump 3320 of the reservoir, wherein the siphon tube 3400 is interconnected with the sump 3320 of the reservoir, and further comprises apertures 3410 through the siphon tube 3400, wherethrough the fluid is drawn from the reservoir 3300 and into the siphon tube 3400. The apertures 3410 are located at the bottom of the sump 3320, further preventing air from entering the siphon tube 3400 or the pump 4000.

A pump 4000 of certain embodiments, shown in FIG. 4B-FIG. 5B is disposed within the body 3000, wherein the pump 4000 has fluid communication the reservoir 3300 through a siphon tube 3400. In certain embodiments a one-way valve 3210 is disposed between the siphon tube 3400 and the reservoir 3300 wherein the fluid passes through the one-way valve 3210 before entering the pump 4000. It will be appreciated that alternate embodiments wherein the one-way valve 3210 is disposed between the siphon tube 3400 and the reservoir 3300 are within the spirit and scope of the present invention.

Figure 5A:
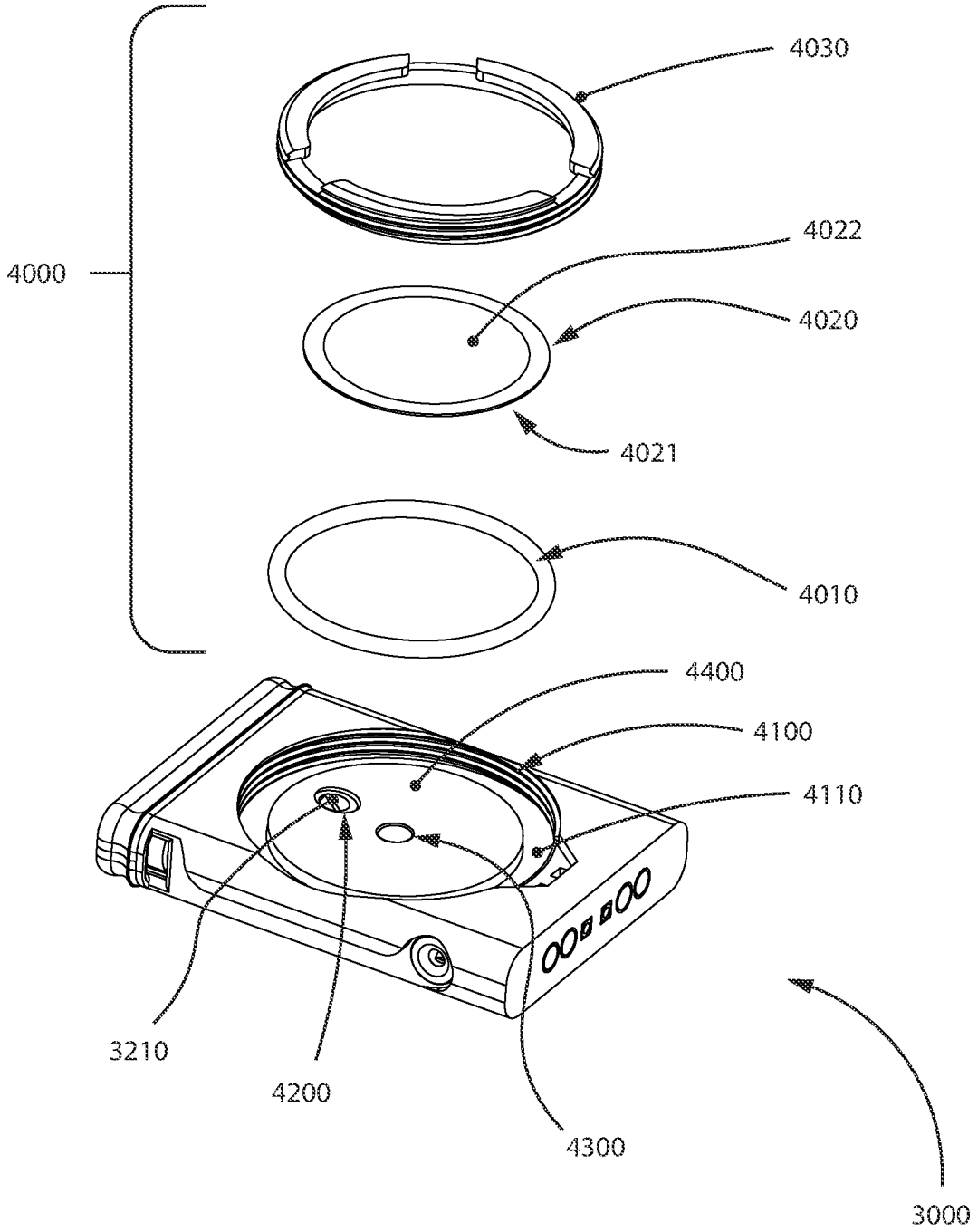
FIG. 5A—A perspective exploded view of a device for dispensing fluids comprising a pod.
Figure 5B:
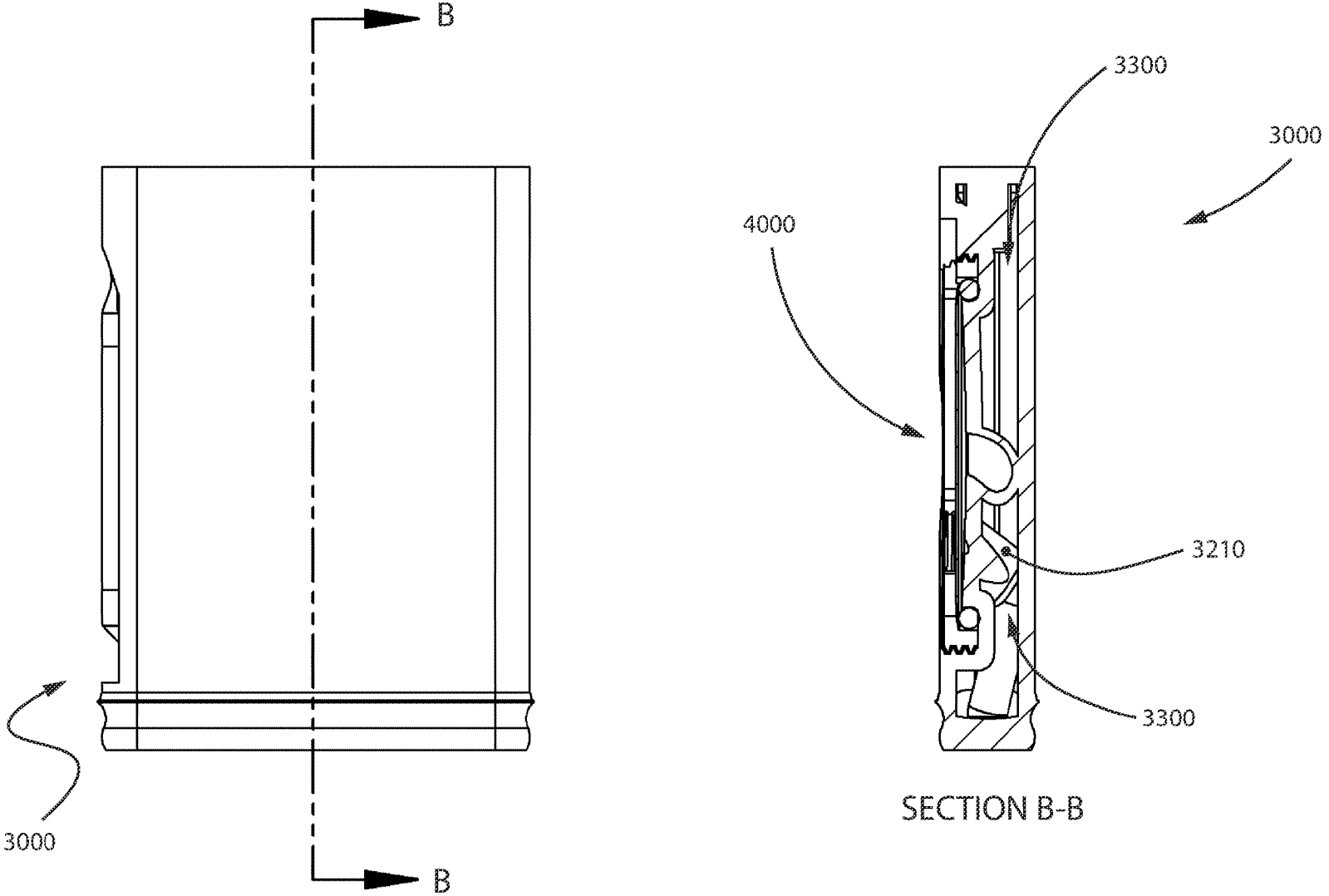

In certain embodiments, seen in FIG. 5A, a pump 4000 comprises a diaphragm pump comprising an O-ring 4010, a diaphragm 4020, and a compression element 4030. The O-ring 4010 of certain embodiments is disposed against a bottom aspect 4110 of a threaded recess 4100 of the body. In certain embodiments, a first face 4021 of the diaphragm is disposed against the O-ring 4010, and the threaded compression element 4030 is disposed against a second face 4022 of the diaphragm. The threaded compression element 4030 is configured to threadably interconnect with the threaded recess 4100 of the body in order to impart pressure on the second face 4022 of the diaphragm. When the threaded compression element 4030 is threadably interconnected with the threaded recess 4100 and threadably advanced, the threaded compression element 4030 imparts pressure on the second face 4022 of the diaphragm, thereby resulting in the first face 4021 of the diaphragm imparting pressure on the O-ring 4010. When pressure is imparted on the O-ring 4010, the O-ring compresses and deforms thereby creating a seal between the O-ring 4010 and the bottom aspect 4110 of the threaded recess and a seal between the O-ring 4010 and the first face 4021 of the diaphragm.

In certain embodiments, a pump 4000 is assembled within the body 3000 wherein the pump 4000 and associated elements are integrated with the body 3000 through the use of soldering, welding, over-molding, adhesive, or other methods appreciated by those skilled in the art.

It will be appreciated that a diaphragm pump, sometimes referred to as a membrane pump, is a positive displacement pump that uses a combination of a reciprocating action of a flexible membrane to pump a fluid. It will be appreciated that the diaphragm of a diaphragm pump 4000 of various embodiments comprise rubber, thermoplastics, Teflon® and/or metal while remaining within the spirit and scope of the present invention.

Certain embodiments, shown in FIG. 5A-FIG. 6B comprise a diaphragm pump 4000 which actuates an intake stroke 4500 and ejection stroke 4600 using piezoelectric effects. When power is supplied to the pump 4000, the diaphragm 4020 deforms away from the body 3000 in an intake stroke 4500, drawing fluid into the pump 4000 through the inlet port 4200. When power is cut from the pump 4000, the diaphragm 4020 rebounds to its resting configuration toward the body 3000 in an ejection stroke 4600, forcing fluid out of the pump through the outlet port 4300. In an intake stroke 4500, the diaphragm pump 4000 creates a suction action wherein fluid is drawn from the reservoir 3300, through the siphon tube 3400, through a one-way valve 3210, and through an inlet port 4200 into the pump 4000. In an ejection stroke 4600, the diaphragm pump 4000, the diaphragm creates a positive pressure, forcing the fluid out of the pump 4000 through an outlet port 4300.

Figure 6A:
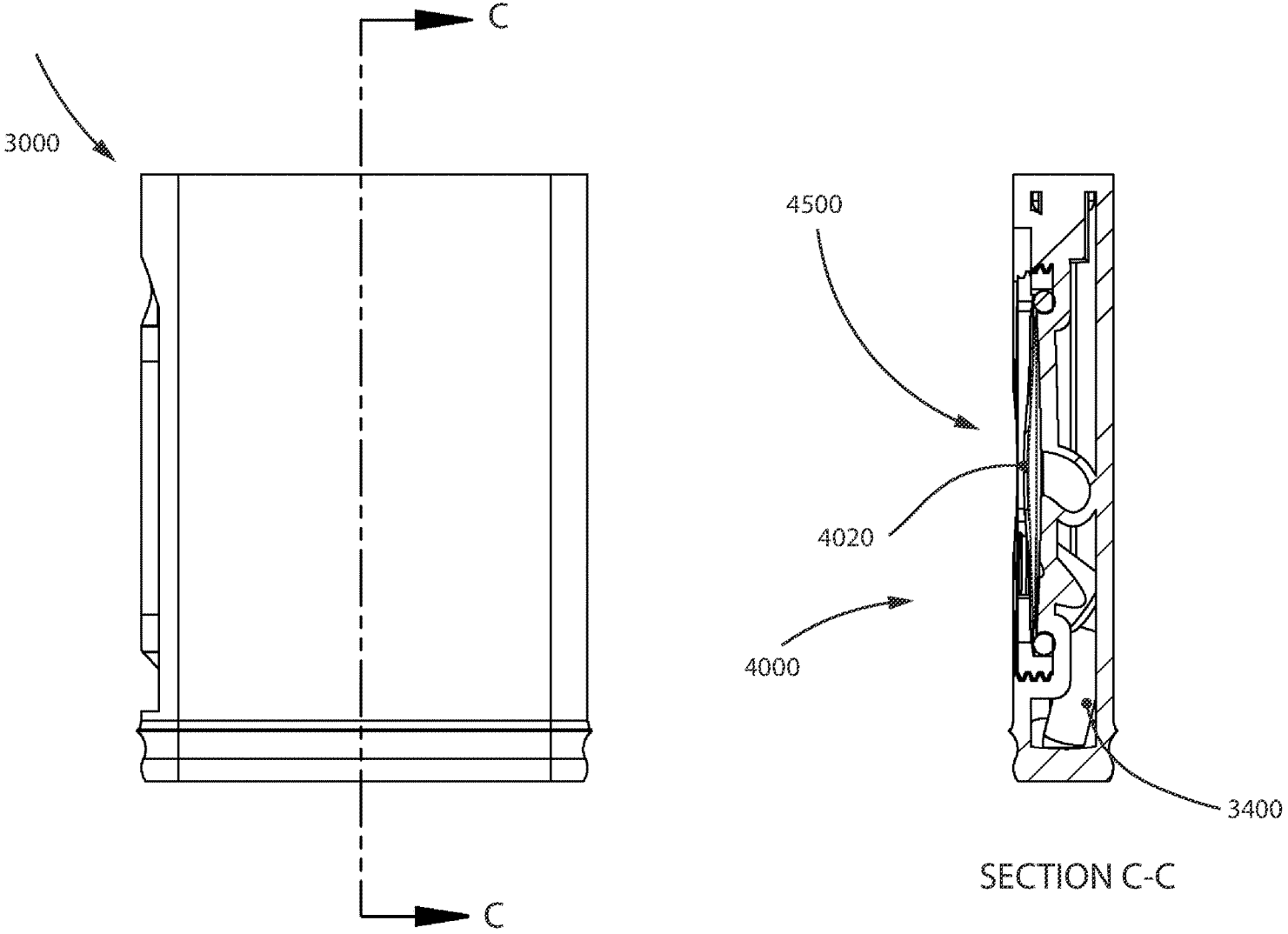
FIG. 6A—A side cross-sectional view of a device for dispensing fluids comprising a pod in an intake stroke configuration.
Figure 6B:
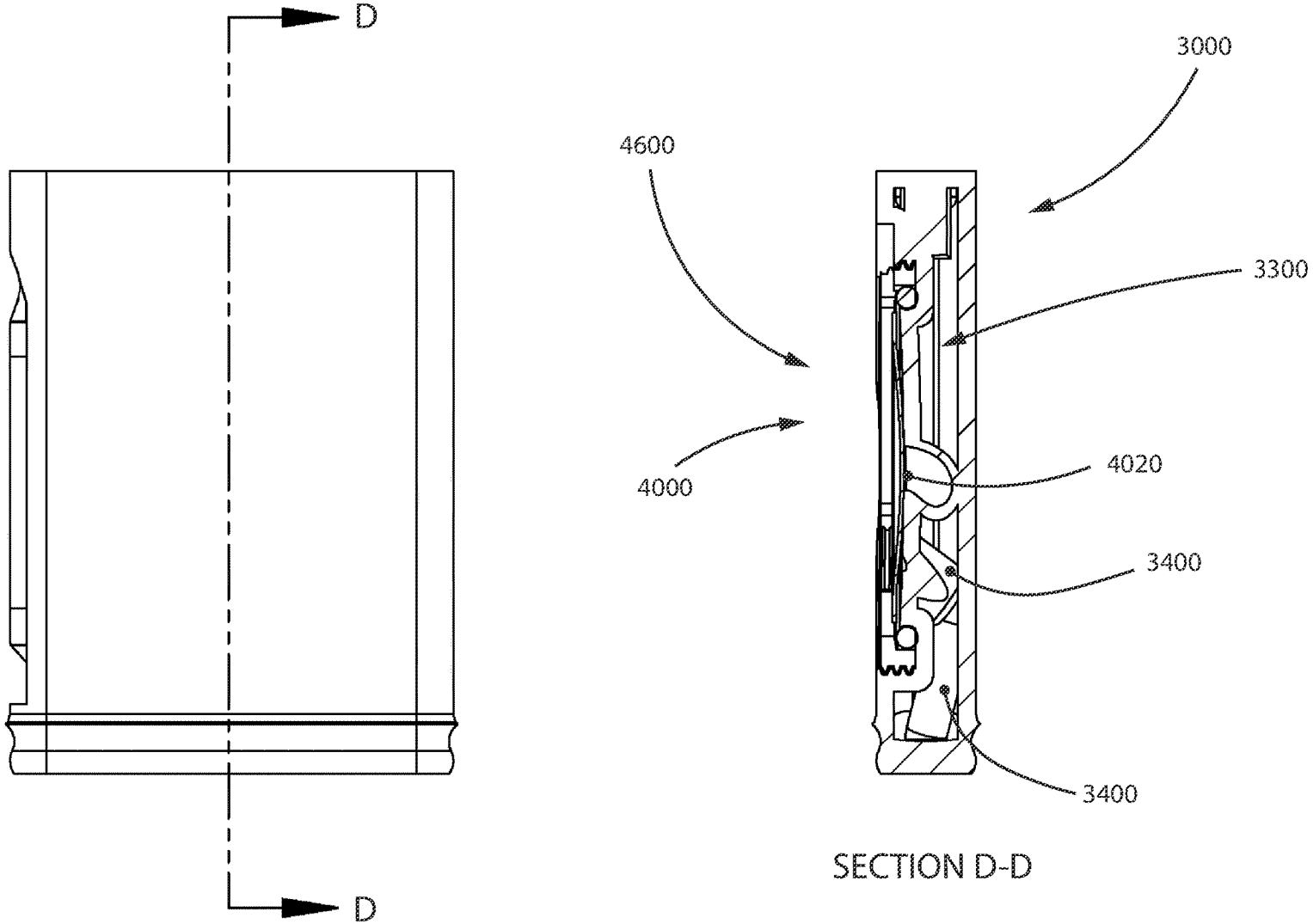
Figure 7:
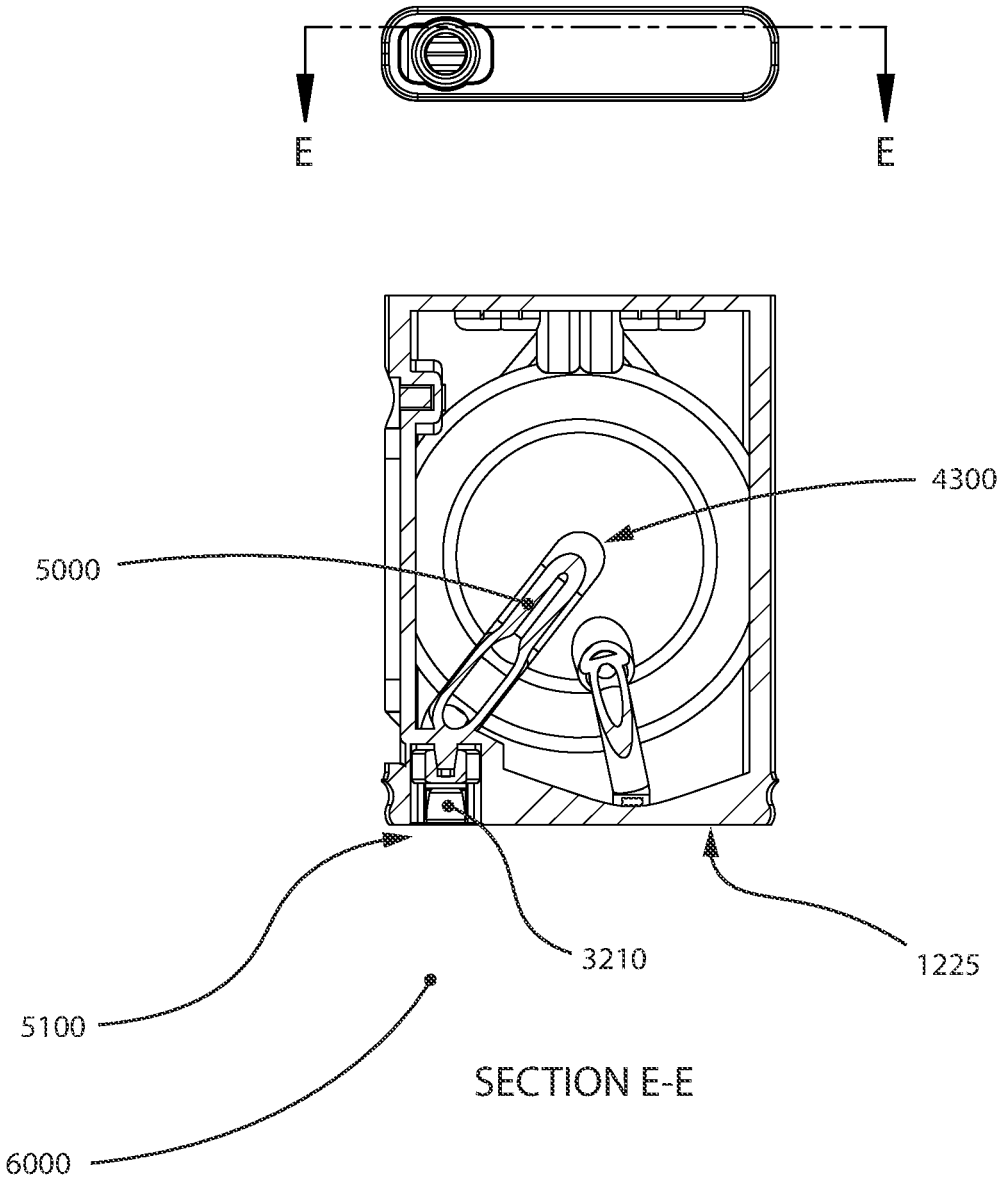
FIG. 7—A front cross-sectional view of a device for dispensing fluids comprising a pod.
Figure 8:
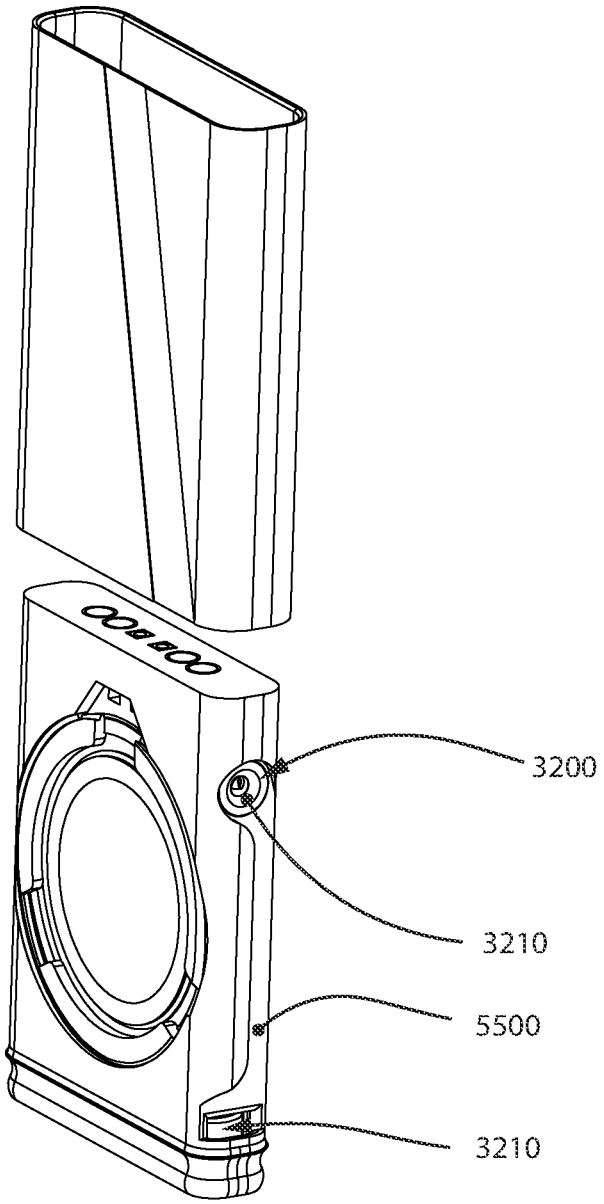
FIG. 8—A perspective exploded view of a device for dispensing fluids comprising a pod.

In certain embodiments (FIG. 5A) a diaphragm pump 4000 comprises a concave 4400 surface wherein the inlet port 4200 and outlet port 4300 are disposed. The concave surface 4400 is configured to interface with the diaphragm 4020 of the diaphragm pump and control the pump "one-stroke" capacity. In certain embodiments, the inlet port 4200 is located in the concave surface 4400, offset from a central aspect of the concave surface 4400. In certain embodiments, the outlet port 4300 is located in the concave surface 4400, adjacent or coincident with the central aspect of the concave surface 4400. The proximity of the outlet port 4300 to the center of the concave surface 4400 allows for most power is in the center more complete ejection of all fluid in the diaphragm pump 4000 during an ejection stroke 4600 (FIG. 6B). In certain embodiments the concavity of the concave surface 4400 is configured to match the curvature of the diaphragm 4020 in an ejection stroke 4600.

In certain embodiments, an outlet duct 5000 is connected to the outlet port 4300. The outlet duct 5000 provides fluid communication between the outlet port 4300 and an external aspect of the pod 1200. In certain embodiments, an outlet 5100 comprising a one-way valve 3210 is disposed between the outlet duct 5000 and an external aspect 6000 of the pod. The one-way valve 3210 allows fluid flow only in the direction from the outlet duct 5000 to the external aspect 6000 of the pod. In certain embodiments the one-way valve 3210 between the outlet duct 5000 and the external aspect 6000 of the pod is disposed on a bottom aspect 1225 of the body of the pod.

In certain embodiments an anti-suction channel 5500 is in gaseous communication with the outlet valve 3210 and the fill-port 3200 of the pod. The anti-suction channel 5500 provides an air-filled volume which serves multiple purposes. A first purpose of the anti-suction channel 5500 is to provide make-up air for the fill-port 3200. As fluid is dispensed, this creates a suction in the reservoir 3300 (FIG. 4B) which is relieved by the fill-port 3200 permitting the passage of air from the anti-suction channel 5500 into the reservoir 3300. A second purpose of the anti-suction channel 5500 is to prevent the misuse of the pod whereby an individual attempts to suck fluid from the outlet valve. The anti-suction channel provides an unsealed plenum of ambient air wherein the sucking of air from a bottom aspect of the pod results in drawing air from the anti-suction channel 5500 and gaps between the body 3000 and the sleeve 3100.

Figure 9:
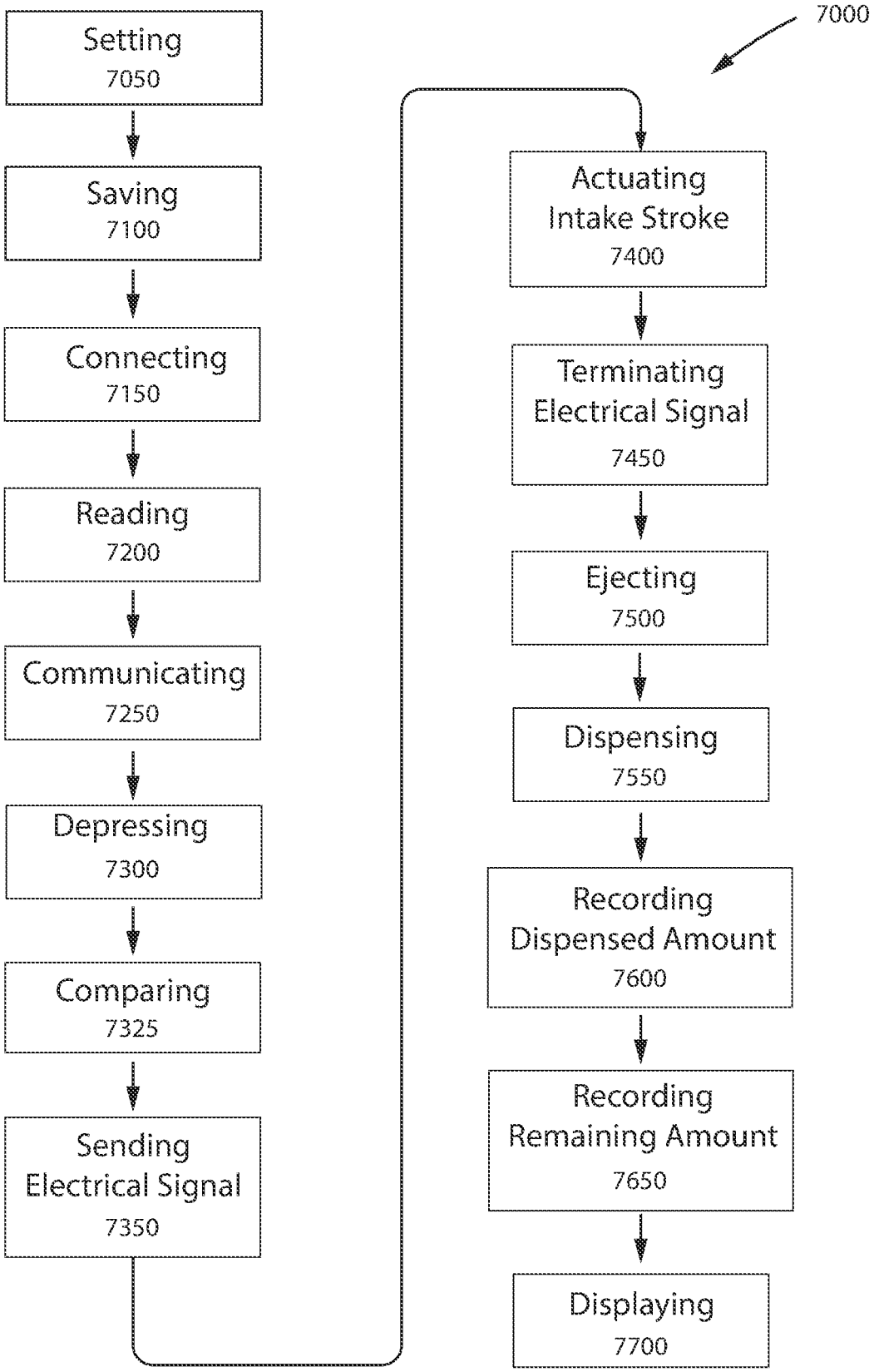
FIG. 9—A diagrammatic representation of a method for dispensing fluids.

Certain embodiments, as shown in FIG. 9, comprise a method 7000 for the dispensing of a fluid comprise:

a) Setting 7050 a preferred dose on a dispenser;
b) Saving 7100 the preferred dose amount to a controller of the dispenser;

c) Connecting 7150 a pod to the dispenser;
d) Reading 7200 pod information from the pod, and saving the pod information to the dispenser;
e) Communicating 7250 wirelessly the pod information from the dispenser to a connected computing device;
f) Depressing 7300 a button disposed on the dispenser;
g) Sending electrical signal 7350 to the pod to actuate an intake stroke;
h) Actuating the intake stroke 7400 of a diaphragm pump resulting in drawing the fluid from a reservoir, through a first one-way valve, through an inlet port, and into the diaphragm pump;
i) Cutting electrical signal 7450 of the electrical signal resulting in actuating an ejection stroke of the diaphragm pump;
j) Ejecting 7500 the fluid from the diaphragm pump through an outlet port and through a second one-way valve;
k) Dispensing 7550 the fluid from the pod;
l) Recording dispensed amount 7600 and time of dispensing to the dispenser;
m) Recording remaining amount 7650 of fluid to the pod; and
n) Displaying 7700 the remaining amount of fluid remaining.

In certain embodiments, a user sets 7050 a preferred dose amount which is saved 7100 to the controller of the dispenser. The dispenser is configured to be removably connected to a pod, and when a user connects 7150 a pod to the dispenser, the dispenser reads 7200 the information from the pod and stores it on the controller. In certain embodiments, the reading step 7200 comprises reading a max dosage permitted for dispensing in a predetermined time period. Certain embodiments further comprise a comparing 7325 step performed prior to the sending electrical signal 7350 step. The comparing step 7325 compares the recorded dispensed amount from previous recording steps 7650 in the predetermined time period prior to the depressing 7300 of the button. If the recorded amount dispensed within the predetermined time period prior to the depressing step 7300 is equal to or greater than the max dosage, the dispenser will not send an electrical signal 7350, thus preventing the dispensing in excess of the max dosage within the predetermined time period. After a max dosage in the predetermined time period is reached, the dispenser will not further dispense fluid until enough time has passed such that less than the max dosage has been dispensed in the predetermined time period prior to the depressing 7300 of the button on the dispenser.

The dispenser of certain embodiments, shown in FIG. 3, further comprises a wireless module 2020 which allows wireless communication with other computing devices 2030 such as a smart phone, computer, or other computing device having local network or internet connectivity. The dispenser of certain embodiments further comprises user input devices, such as buttons 2040, a display 2050, a USB port 2060 for wired connection to other computing devices, a charging circuit 2070, a battery for power storage 2000, a voltage regulator 2080, a driver 2090 for the delivery of electrical signals from the dispenser to a pod, electrical connections for the purposes of providing power and electrical signals between the dispenser and pod, and electrical connections for the purpose allowing the reading and writing of data between the dispenser and the pod.

In certain embodiments, the pod comprises memory storage 2110 wherein the dispenser can store the data associated with the dispensed amount, date of dispensing, and/or the amount of fluid remaining in the pod. Certain embodiments of the pod comprises a piezo-electric crystal 2100.

In certain embodiments as shown in FIG. 9—user input, such as the depressing of a button 2040 (FIG. 1-FIG. 3) indicates to the dispenser that the user wishes to dispense the pre-programmed desired amount of fluid. The depressing 7300 of the button initiates the controller sending 7350 electrical signals through the driver and through the driver to the pod. The electrical signal actuates 7400 the pump into an intake stroke wherein the diaphragm deflects from the body and away from the concave surface of the body. During the intake stroke the fluid is drawn from the reservoir, through the siphon tube, and through a first one-way valve into the pump. Following the intake stroke, terminating the electrical signal 7450 results in the diaphragm deflecting toward the concave surface in an ejection stroke, thereby ejecting 7500 the fluid from the pump through an outlet port of the pump, though an outlet duct, and through a one-way valve and thereby dispensing 7550 the fluid. Following the dispensing of fluid, in certain embodiments, the dispenser records 7600 the dispensed amount and time of dispensing to the dispenser. In certain embodiments, the method further comprises a step wherein the dispenser records 7650 the amount remaining within the pod to the memory of the pod.

In certain embodiments comprising a dispenser, the dispenser further comprises a tilt sensor 2200 (FIG. 3), wherein the dispense does not send an electrical signal unless the device is in an upright orientation (FIG. 1) or substantially upright to ensure dispensing in the right direction and prevent air from entering the pump. It will be appreciated that a tilt sensor 2200 of certain embodiments comprises an accelerometer to measure the direction of gravitational acceleration, thus confirming the upright orientation of the pod prior to dispensing.

Figure 10A:
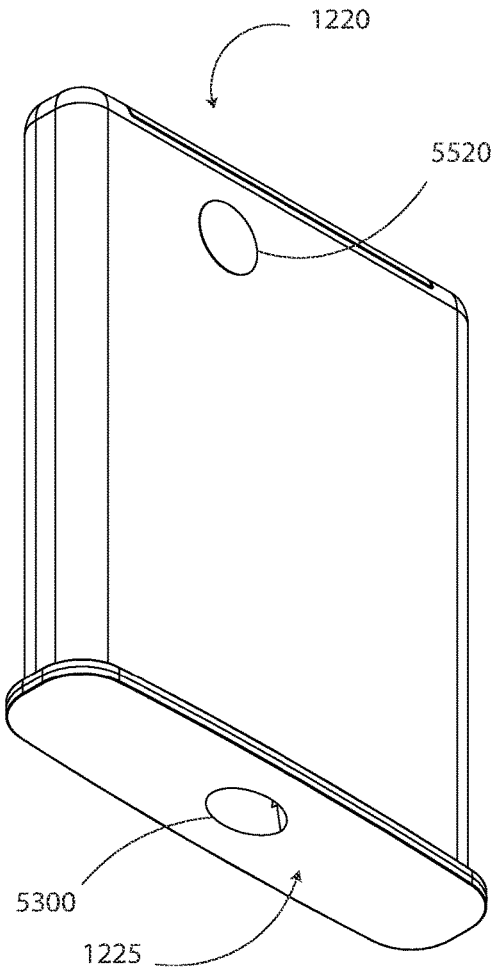
FIG. 10A—A bottom perspective view of certain embodiments of the present invention FIG. 10B—A top perspective view of certain embodiments of the present invention FIG. 11A—A front view of certain embodiments of the present invention FIG. 11B—A side view of certain embodiments of the present invention FIG. 11C—A side cross-sectional view of the embodiment shown in FIG. 11A FIG. 11D—A side cross-sectional view of the embodiment shown in FIG. 11A FIG. 11E—A front cross-sectional view of the embodiment shown in FIG. 11B FIG. 11F—A detail cross-sectional view of the embodiment shown in FIG. 11E FIG. 11G—A detail cross-sectional view of the embodiment shown in FIG. 11F FIG. 11H—A detail cross-sectional view of the embodiment shown in FIG. 11F
Figure 10B:
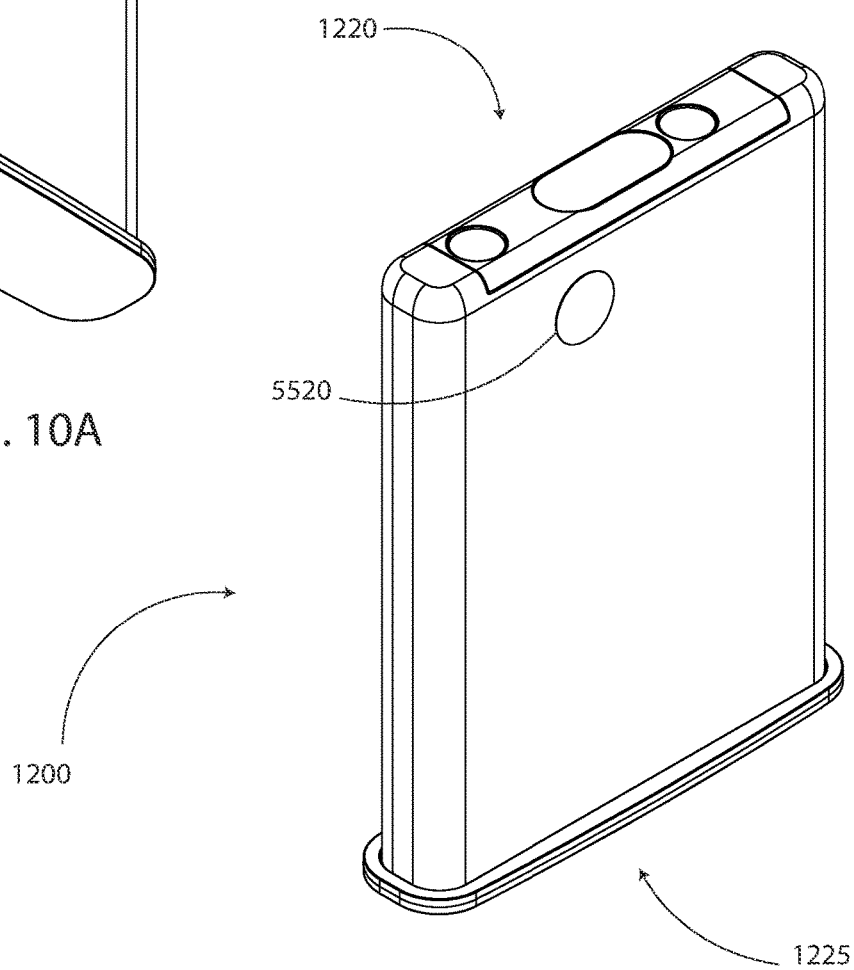
Figure 11A:
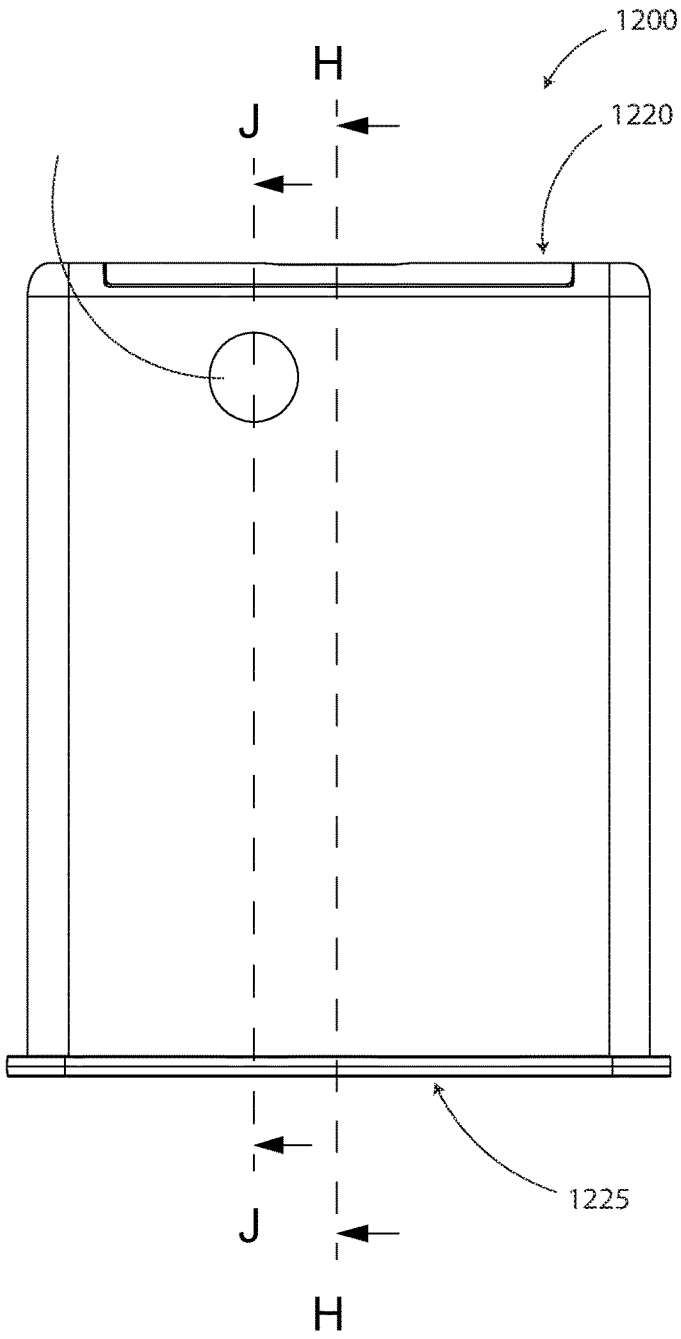
Figure 11B:
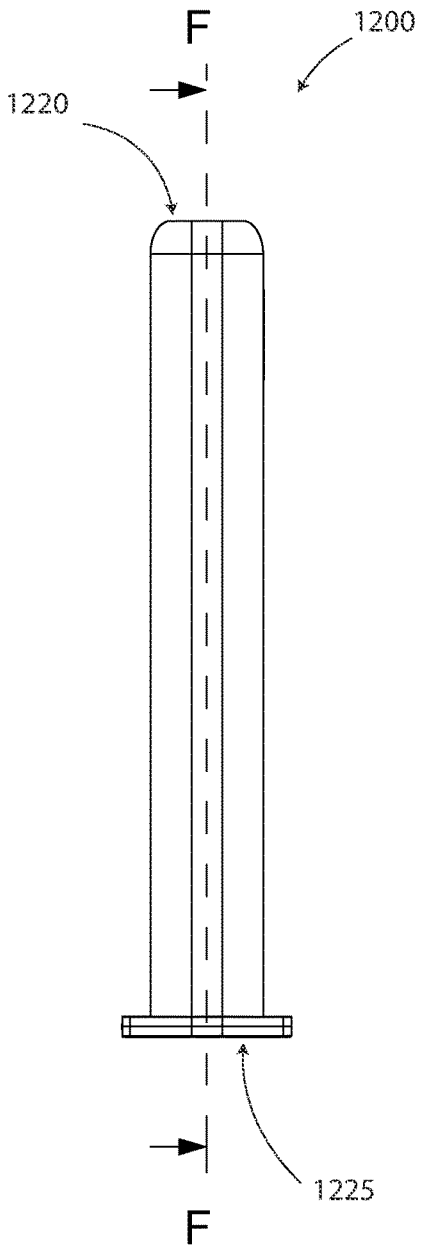
Figure 11C:
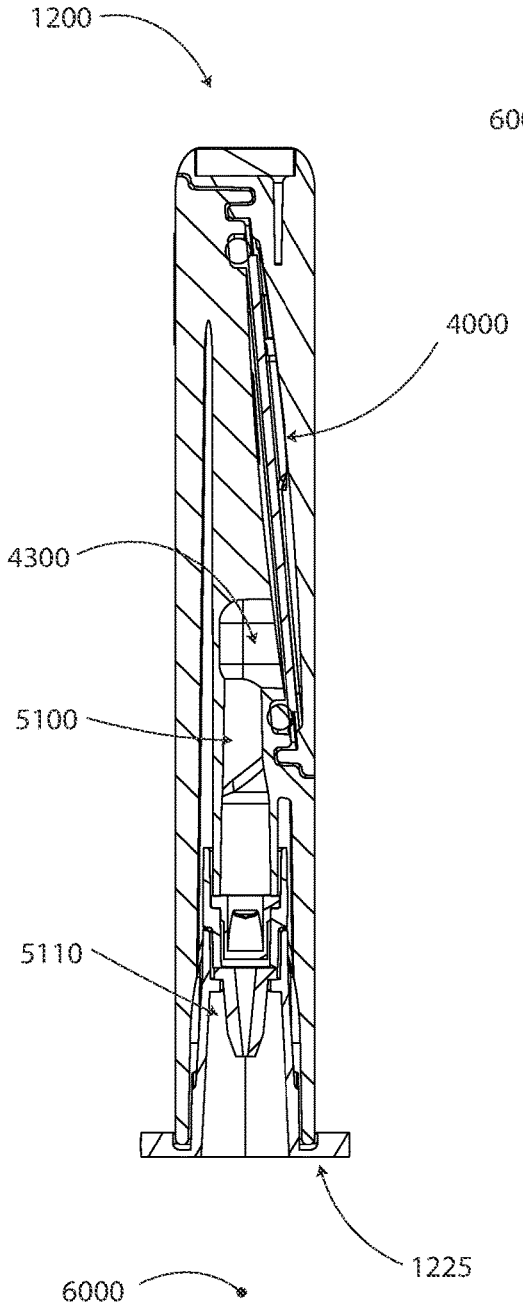
Figure 11D:
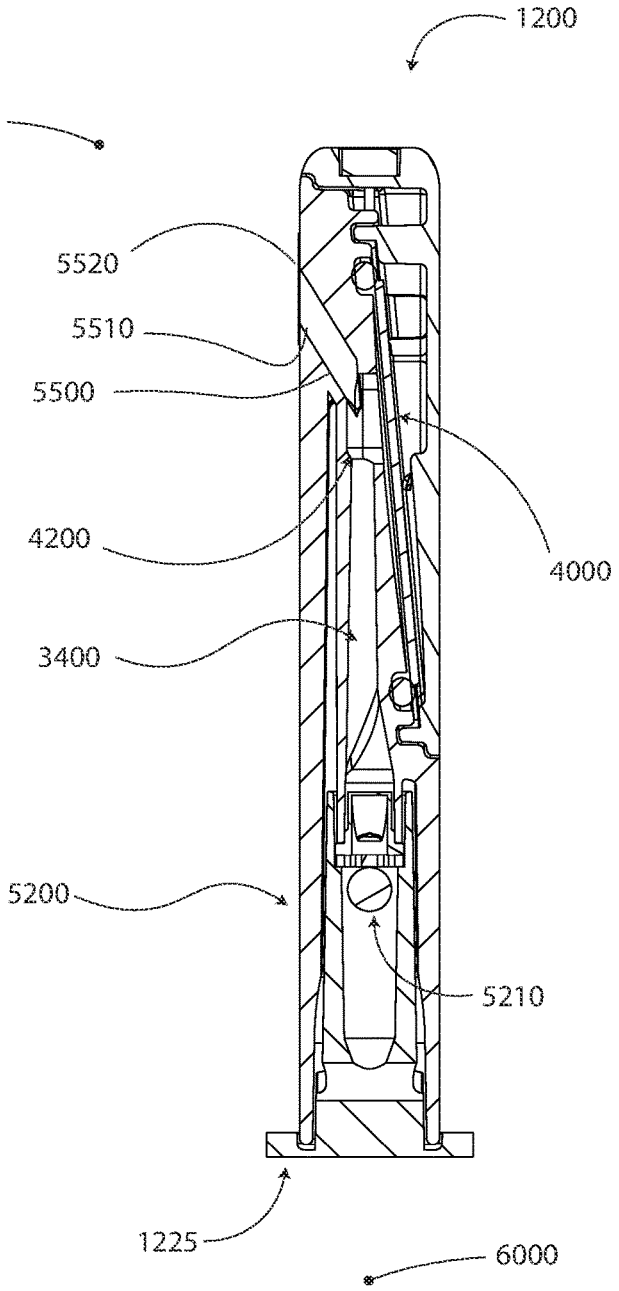
Figure 11E:
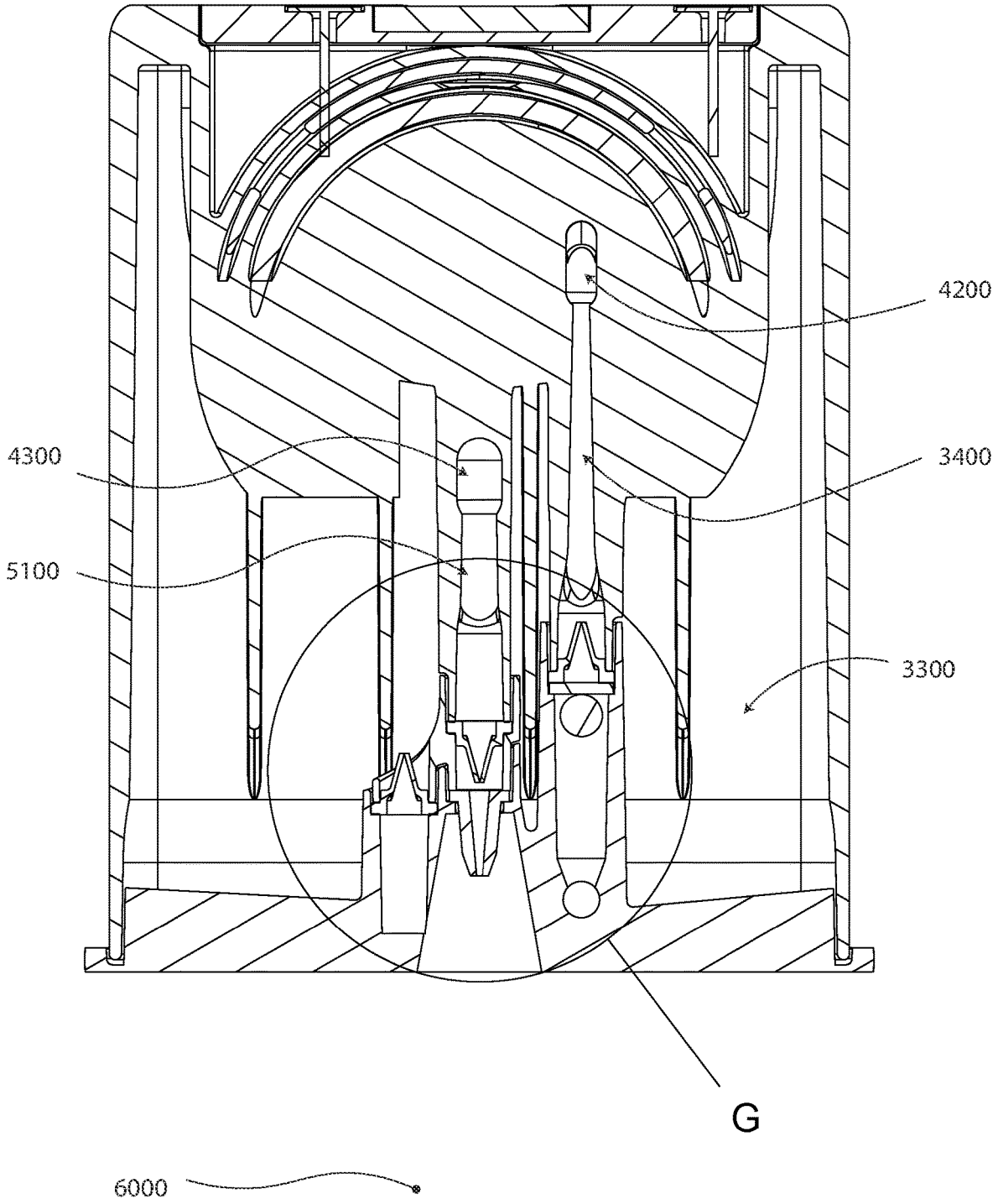
Figure 11F:
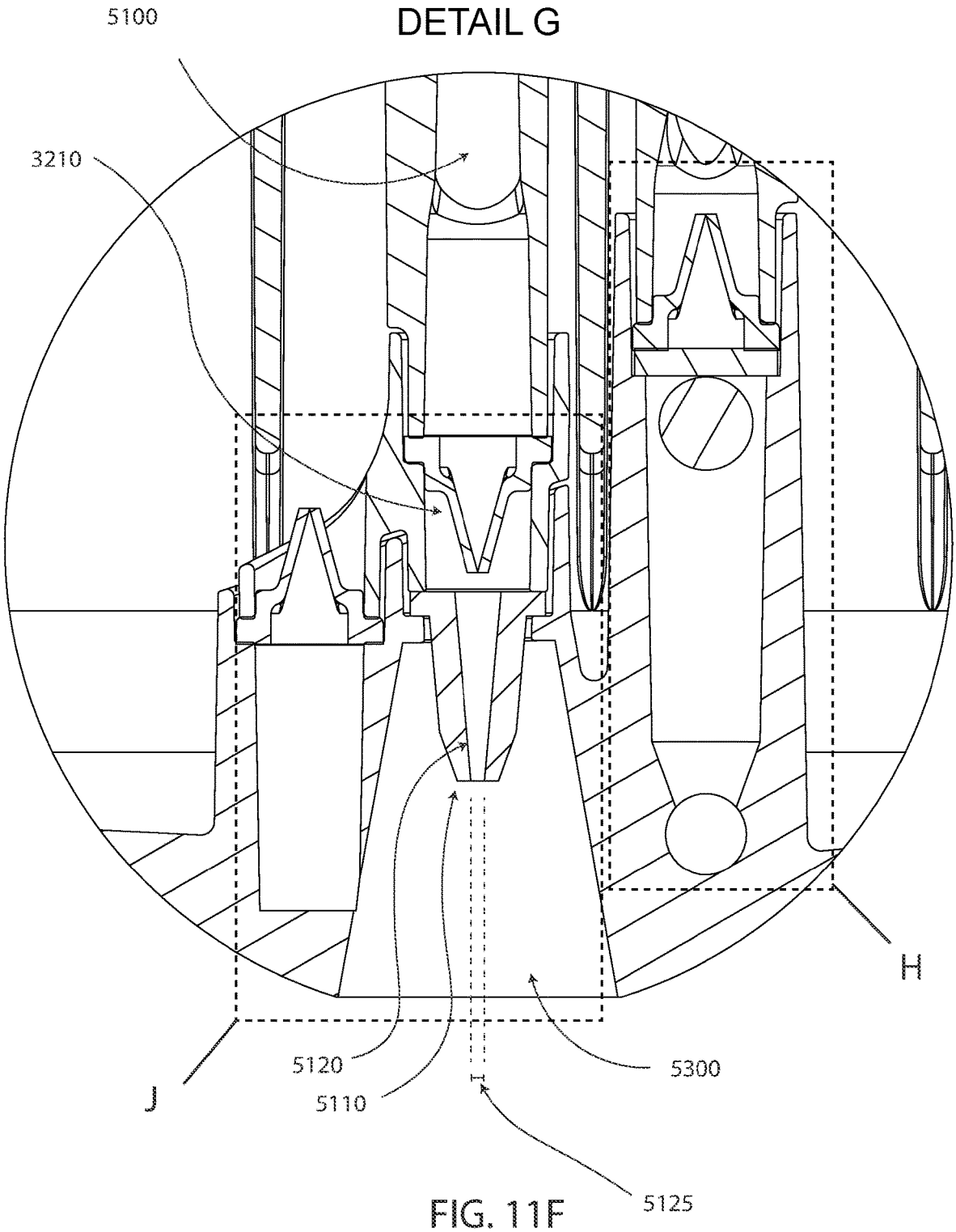
Figure 11G:
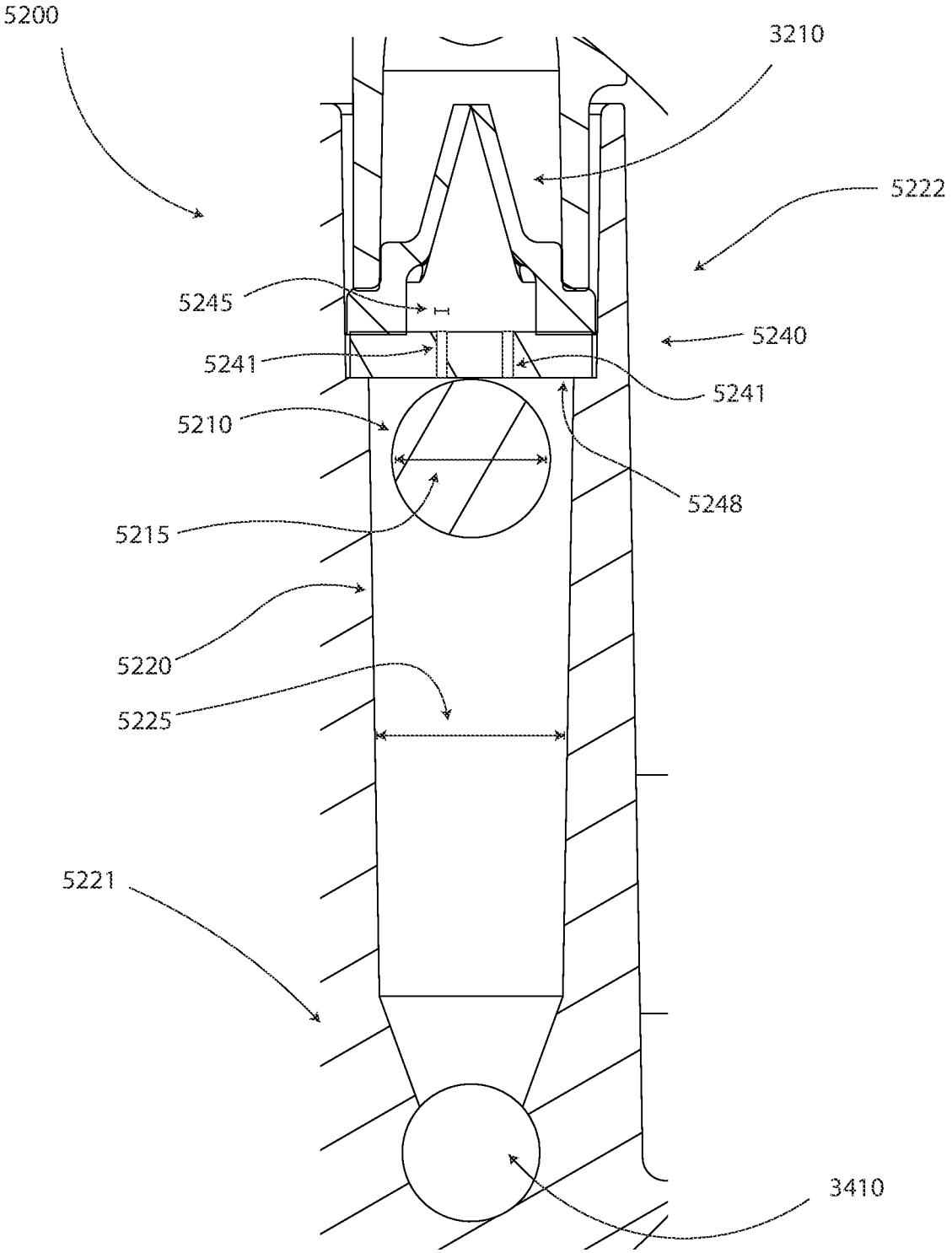
Figure 11H:
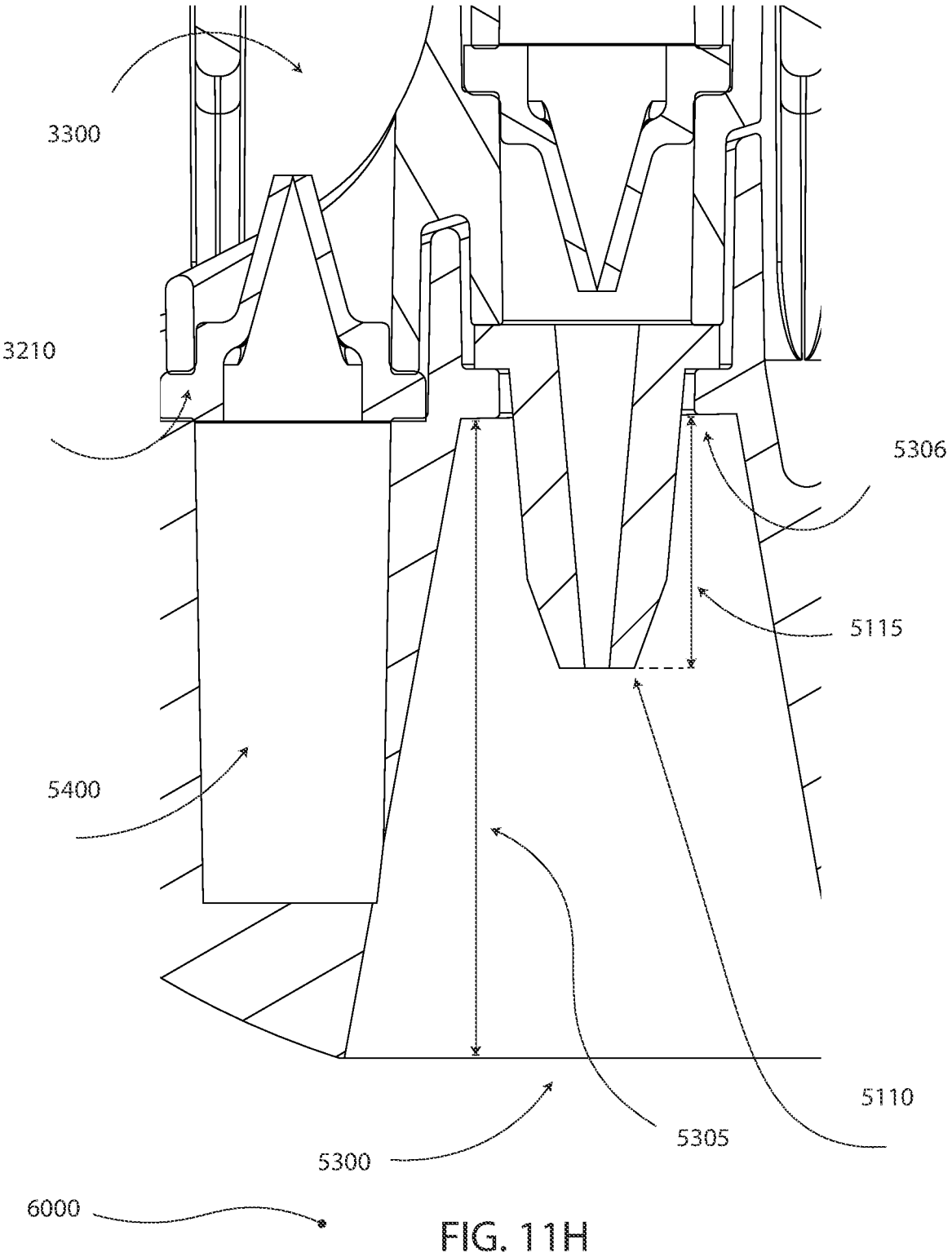

FIG. 10A and FIG. 10B show certain alternate embodiments of a pod 1200 for dispensing wherein fluid is dispensed through the bottom aspect 1225 of the pod, and the top aspect 1220 of the pod is configured to interconnect with a dispenser unit.

In certain embodiments of the present invention, as shown in FIG. 10A-FIG. 11E for instance, the inlet port 3210 of the pump is located vertically above the outlet port 4300 of the pump when the pod 1200 is in an upright orientation. Thus an air that may enter the pump 4000 through the inlet port 3210 floats up and away from the outlet port 4300 thus preventing the air from entering the outlet port 4300 when dispensing. While preferred that the pod 1200 be held in a vertically upright orientation for dispensing, an "upright orientation" as referred to herein is defined as when the top aspect 1220 of the pod is elevated above the bottom aspect 1225 of the pod.

In certain embodiments of the present invention, as shown in FIG. 11A-11F for instance, a nozzle 5110 is interconnected the outlet duct 5100 wherein the nozzle 5110 is configured to dispense fluid therethrough to an external aspect 6000 of the pod. In certain embodiments, nozzle 5110 is configured to allow the flow of fluid therethrough when under positive pressure, but prevent the passive flow of fluid therethrough under neutral pressure between the outlet duct and the external aspect of the pod. For instance, an ejection stroke 4600 (FIG. 5A—6B) creates a positive pressure differential wherein the pressure within the outlet duct 5100 is greater than the external aspect of the pod 6000, thereby dispensing fluid through the nozzle 5110. The nozzle 5110 comprises an aperture 5120 for the dispensing of fluid therethrough wherein a minimum diameter 5125 of the aperture is configured accordingly with the cohesive properties of the fluid to be dispensed, and the viscosity of the fluid to be dispensed to prevent passive flow therethrough. In certain embodiments, the minimum diameter 5125 of the aperture of the nozzle is less than 1 mm, while further embodiments comprise a minimum diameter 5125 between 0.25 mm and 0.75 mm. Alternate embodiments having a nozzle outside of the provided values to accommodate a more viscous or less viscous fluid for dispensing are within the spirit and scope of the present invention. As shown, the aperture 5120 comprises a tapered profile, however the aperture 5120 of the nozzle of alternate embodiments can comprise a stepped profile, inverted stepped profile, constant diameter profile, or inverted tapered profile while in keeping the spirit and scope of the present invention.

In certain embodiments, the outlet duct 5100 further comprises a one-way valve 3210 interconnected between the nozzle 5110 and the outlet port 4300. The one-way valve 3210 of the outlet duct is configured to allow flow from the outlet port 4300 and the external aspect 6000 of the pod, but restrict flow in the opposite direction. The one-way valve 3210 further prevents passive flow through the nozzle wherein the one-way valve 3210 is configured to maintain a neutral pressure differential between the one-way valve 3210 and the nozzle, and thereby further prevents passive flow or leakage through the nozzle 5110. In certain embodiments the nozzle 5110 comprises a one-way valve 3210, thus the nozzle and the 5110 and the one-way valve 3210 located between the nozzle 5110 and the outlet port 4300 work together to prevent passive flow or leakage from the nozzle 5110.

In certain embodiments of the present invention, shown in FIG. 11A-FIG. 11G for instance, the siphon tube 3400 further comprises a float vent valve 5200 configured to prevent the entry of air bubbles into the siphon tube 3400 when the pod 1200 is in an inverted orientation, and allow fluid flow when the pod 1200 is in an upright orientation. An "inverted orientation" as referred to herein is defined as when the bottom aspect 1225 of the pod is elevated above the top aspect 1220 of the pod. The float vent valve 5200 comprises a float 5210 configured to travel along the length of a tube 5220. The tube 5220 of the float valve comprises a first end 5221 configured to receive fluid from the reservoir 3300 through an aperture 3410 in the siphon tube 3400, for subsequent communication toward the inlet port 4200 and into the pump 4000. The tube comprises a maximum inner diameter 5225 greater than a maximum diameter 5215 of the float. The first end of the tube 5221 comprises a constricted portion 5230 wherein the maximum inner diameter 5235 of the constricted portion is less than the maximum outer diameter 5215 of the float. The second end 5222 of the tube comprises a fluid bypass 5240 configured to arrest the travel of the float 5210 toward the inlet port 4200 while allowing the flow of fluid therethrough. The fluid bypass 5240 comprises at least one aperture 5241 having a maximum diameter 5245, wherein the maximum diameter 5245 of the aperture of the fluid bypass is less than the maximum outer diameter 5215 of the float. Thus, the float 5210 is arrested and fluid is permitted to pass through the fluid bypass 5240. In certain embodiments, the fluid bypass 5240 comprises a plate 5248 comprising a plurality of apertures 5245 therethrough.

In certain embodiments, the siphon tube 3400 further comprises a one-way valve 3210 interconnected between the float vent valve 5200 and the inlet port 4200, wherein the use of the one-way valve 3210 in conjunction with the float vent valve 5200 maintains a static pressure within the tube 5220 configured to maintain fluid within the tube 5220. Thus, when the pod 1200 is in an upright configuration, the float 5210 buoys to the second end 5222 of the tube 5220 and allows the drawing of fluid therethrough during in intake stroke 4500 (FIG. 5A-FIG. 6B) and prevents the flow of fluid from the pump 4000 toward the reservoir in an ejection stroke 4600 or passively when the pod 1200 is not in use. When the pod 1200 is in an inverted orientation, the float 5210 buoys to the first end 5221 of the tube wherein the float 5210 interfaces with the constricted portion 5230 of the tube which prevents the flow of fluid or gas from the reservoir 3300 into the siphon tube 3400.

Certain embodiments of the present invention, such as shown in FIG. 11A-FIG. 11F and FIG. 11H for instance, comprise a recess 5300 in the bottom aspect 1225 of the pod. The nozzle 5110 is interconnected to the pod 1200 within the recess 5300, wherein the nozzle 5110 extends downward from an upper aspect 5306 of the recess. The recess 5300 comprises a depth 5305 which is greater than the height 5115 of the nozzle, thus the nozzle 5110 is contained within the recess 5300 and does not extend beyond the bottom aspect 1225 of the pod.

In certain embodiments, such as shown in FIG. 11A-FIG. 11F and FIG. 11H for instance, the pod further comprises an air volume 5400 in gaseous communication with an external aspect 6000 of the device. The air volume comprises a one-way valve 3210 interconnected thereto configured to allow the flow of air from the air volume 5400 to the reservoir 3300. The one-way valve 3210 of the air volume 5400 is configured to allow the flow of air from an external aspect 6000 of the pod into the reservoir 3300 following an ejection stroke to equalize a negative pressure differential caused by the displacement of fluid out of the reservoir 3300. As shown, the air volume 5400 is in adjacent to and in gaseous communication with the recess 5300, however alternate embodiments do not require the proximal location or gaseous interconnection of the air volume 5400 in relation to the recess 5300.

In certain embodiments, as shown in FIG. 11A-FIG. 11E for instance, the siphon tube 3400 comprises an air chamber 5500 interconnected thereto wherein the air chamber 5500 is configured to separate air from the fluid for dispensing. The air chamber 5500 is configured to extend upward from the siphon tube 3400, and preferably with an upper aspect 5510 of the air chamber above the inlet port 4200 when the pod is in an upright orientation. The air chamber is configured to separate air bubbles entrained in the fluid for dispensing prior to entering the pump 4000 through the inlet port 4200. The air upper aspect 5510 of the air chamber further comprises a semi-permeable membrane 5520 configured to allow gasses to pass therethrough but prevent the passage of liquids. The semi-permeable membrane 5520 as shown is configured to allow gas to travel from the air chamber 5500 to the reservoir 3300. However, alternate embodiments wherein the semi-permeable membrane is configured to allow the travel of gas from the air chamber 5500 to the external aspect of the pod 1200 are within the spirit and scope of the present invention.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A device for the dispensing of a fluid comprising:

a reservoir configured to contain a fluid;

a diaphragm pump comprising an inlet port interconnected with a siphon tube, the siphon tube configured to provide fluid communication from the reservoir toward the inlet port;

the pump further comprises an outlet port interconnected with an outlet duct, the outlet duct configured to provide fluid communication from the outlet port of the pump toward an external aspect of the pod, wherein the inlet port is located vertically above the outlet port, and the outlet port is located above a bottom aspect of the reservoir, when the device is in an upright configuration.

2. The device of claim 1 further comprising:

a nozzle interconnected to the outlet duct, wherein the nozzle is configured to dispense a fluid to the external aspect of the device; and the outlet duct further comprises a first one-way valve interconnected between the nozzle and the outlet port, wherein the one-way valve of the outlet duct is configured to allow the flow of fluid in a direction from the outlet duct toward the nozzle, and restrict the flow of fluid in a direction from the nozzle toward the diaphragm pump.

3. The device of claim 2, wherein the nozzle comprises an aperture therethrough wherein the minimum diameter of the nozzle aperture is less than 1 mm (0.039 in).

4. The device of claim 2, wherein the nozzle comprises an aperture therethrough wherein the minimum diameter of the nozzle aperture is between 0.25 mm (0.0098 in) and 0.75 mm (0.030 in).

5. The device of claim 2 wherein, the nozzle comprises a one-way valve.

6. The device of claim 1, wherein the siphon tube further comprises float vent valve;

the float vent valve comprising a buoyant float therein, wherein the float vent valve is configured to allow fluid flow therethrough when the device is in an upright orientation, and wherein the float vent valve is configured to restrict fluid flow therethrough when the device is in an inverted configuration.

7. The device of claim 6, wherein the float vent valve comprises a tube wherethrough the float and is configured to travel through the tube, wherein a first end of the tube is configured to receive fluid from the reservoir, and a second end of the tube is configured to communicate fluid toward to the inlet port;

the float comprising a maximum outer diameter less than the maximum inner diameter of the tube;

the first end of the tube comprising a constricted portion wherein a maximum inner diameter of the constricted portion is less than the maximum outer diameter of the float;

the second end of the tube comprising a fluid bypass, the fluid bypass configured to arrest the travel of the float, and allow the flow of fluid therethrough; and the fluid bypass comprising at least one aperture with a diameter less than the maximum diameter of the float.

8. The device of claim 7, wherein the fluid bypass comprises a plurality of apertures.

9. The device of claim 7, wherein the siphon tube further comprises second one-way valve interconnected between the float vent valve and the inlet port.

10. The device of claim 7 wherein when the pod is in an upright orientation, the float is configured to buoy toward the second end allowing flow from the reservoir, through the float vent valve, and into the siphon tube, and wherein when the pod is in an inverted orientation, the float is configured to buoy toward the first end wherein the interface between the float and the constricted portion of the tube prevents flow therethrough.

11. The device of claim 1 further comprising:

a recess in a bottom aspect of the device, the recess having a depth, and wherein the recess is in gaseous communication with the external aspect of the device; and the nozzle interconnected within the recess wherein the nozzle extends downward from an upper aspect of the recess, wherein a height of the nozzle is less than the depth of the recess.

12. The device of claim 11 further comprising:

an air volume in gaseous communication with the external aspect of the device; and the air volume comprises a one-way valve configured to allow flow from the air volume into the reservoir, wherein the one-way valve of the air volume is configured to allow air to flow from an external aspect of the device into the reservoir to equalize a negative pressure differential between the external aspect of the device and the reservoir.

13. The device of claim 12, wherein the air volume is in gaseous communication with the recess.

14. The device of claim 1, wherein the internal surface of the reservoir comprises a hydrophilic surface coating.

15. The device of claim 1, further comprising an air chamber interconnected to the siphon tube wherein the air chamber extends upward from the siphon tube.

16. The device of claim 15, wherein an upper aspect of the air chamber is vertically above the inlet port when the device is in an upright configuration.

17. The device of claim 16, wherein the upper aspect of the air chamber comprises a semipermeable membrane configured to allow air to pass therethrough but is impervious to a liquid.

18. The device of claim 17, wherein air passing through the semipermeable membrane vents into the reservoir.

19. The device of claim 18, wherein air passing through the semipermeable membrane vents to an external aspect of the device.

* * * * *